US011505381B1

(12) United States Patent
Mousseau et al.

(10) Patent No.: US 11,505,381 B1
(45) Date of Patent: Nov. 22, 2022

(54) SYSTEM AND METHOD FOR IMPROVING THE ACCESSIBILITY OF DRUGS USING A REUSABLE PACKAGING MECHANISM

(71) Applicant: 3D BRIDGE SOLUTIONS INC., Vancouver (CA)

(72) Inventors: Gary Mousseau, Waterloo (CA); Samuel Thomas MacKenzie, Toronto (CA); Karima Bawa, Vancouver (CA)

(73) Assignee: 3D Bridge Solutions Inc., Vancouver (CA)

( * ) Notice: Subject to any disclaimer, the term of this patent is extended or adjusted under 35 U.S.C. 154(b) by 0 days.

(21) Appl. No.: 17/689,754

(22) Filed: Mar. 8, 2022

(51) Int. Cl.
*B65D 75/36* (2006.01)
*B65D 75/32* (2006.01)
*A61J 1/03* (2006.01)

(52) U.S. Cl.
CPC ..... *B65D 75/367* (2013.01); *A61J 1/035* (2013.01); *B65D 75/327* (2013.01); *A61J 2205/30* (2013.01); *B65D 2075/361* (2013.01); *B65D 2203/02* (2013.01); *B65D 2575/3218* (2013.01); *B65D 2575/363* (2013.01); *B65D 2575/586* (2013.01)

(58) Field of Classification Search
CPC ..... B65D 5/38; B65D 75/367; B65D 75/327; B65D 2075/361; B65D 2203/02; B65D 2575/3218; B65D 2575/363; B65D 2575/586; A61J 1/035; A61J 2205/30
USPC ..... 206/468
See application file for complete search history.

(56) References Cited

U.S. PATENT DOCUMENTS

| | | | | | |
|---|---|---|---|---|---|
| 3,812,963 | A * | 5/1974 | Zahuranec | B65D 75/366 | 220/345.3 |
| 5,878,887 | A * | 3/1999 | Parker | B65D 43/20 | 220/345.3 |
| 5,938,031 | A * | 8/1999 | Woods | G03D 15/001 | 206/455 |
| 8,328,016 | B2 * | 12/2012 | Thornton | B65D 73/0092 | 206/468 |
| 2003/0047482 | A1 * | 3/2003 | Jones | B65D 83/0463 | 206/534 |
| 2010/0243507 | A1 * | 9/2010 | Gelardi | B65D 73/0085 | 206/468 |
| 2021/0163171 | A1 * | 6/2021 | Young | B65D 5/38 | |

* cited by examiner

*Primary Examiner* — Jacob K Ackun
(74) *Attorney, Agent, or Firm* — Norton Rose Fulbright Canada LLP; Maya Medeiros

(57) ABSTRACT

Embodiments relate to systems and methods for resealable packaging, to improve the accessibility of medications. Embodiments relate to systems and methods for resealable packaging with a bottom element with one or more storage areas, and a top element of a corresponding size to the bottom element. The top element couples to the bottom element and has apertures to expose the storage areas of the bottom element. The top element has a sliding middle section movable between a sealed closed position to cover the apertures and an open position to uncover to expose the one or more storage areas.

20 Claims, 21 Drawing Sheets

SYSTEM AND METHOD FOR IMPROVING THE ACCESSIBILITY OF DRUGS USING A REUSABLE PACKAGING MECHANISM

FIELD

Embodiments relate to systems and methods for resealable packaging, and medication or drug packaging. In particular, embodiments relate systems and methods for resealable packaging to improve the accessibility of medications.

INTRODUCTION

Medications or drugs can be packaged in packaging, such as multi-package containers and blister packs. The blister pack delivery systems can guide the medication consumer to a specific frequency of medication consumption and can provide guidance on the times in the day to consume their medications, and the types and amounts of medications to consume. A user can become ill (and can even die) if they do not consume medication on time or if they forget to consume their medication, or consume the wrong type or amounts of medication. Additionally, there are machines which can help place medication into medication packages or blister packs to assist a pharmacist and accelerate the creation of blister packs for pharmacies.

Blister packaging can also reduce drug diversion as it is an enclosed package sealed with adhesive and must be punctured to consume the medications contained within the blister package. Medication diversion occurs when one or more people who have access to the medications remove some or all of the medications before the packaging reaches the user. Medication diversion is a widespread problem in various environments including in hospitals, nursing homes and long-term care homes.

There are several problems associated with blister packaging. For example, the use of blister packaging leads to a high amount of mixed-media garbage because there is a combination of plastic, box board, paper and tin foil. With this degree of material mixing blister packaging cannot be easily recycled.

Another important problem is that puncturing and accessing the medication within the packaging requires reasonably high dexterity. In some cases, the medication consumer (or other person accessing the medication for the consumer) for these blister packs may have limited dexterity and strength. For instance, the elderly, frail and those with individuals with comorbidities that have dexterity and/or strength issues.

Another problem is that when the blister is punctured or when medications have to be taken out of a blister package, it is easier for a pill to drop out or get damaged.

Another problem is that there is no way to confirm the consumption of drugs in a blister package. For those supporting a fail elderly person the need to track and keep the medication consumer on track with their medications is essential.

Another problem that can happen at the pharmacy when placing a large number of medications into a single storage area of the blister pack, is that a pharmacist's final double-check is hard to perform. When the blister pack is sealed and closed it can be extremely hard to verify each medication, leading to medication mistakes.

There exists a need for improved packaging to address the problems associated with blister packages. There exists a need for packaging with improved accessibility, that assists users with dexterity issues, reduces potential spillage issues when accessing the pills, and addresses the challenges when trying to verify what medications have been packaged into the blister pack. There exists a need for packaging with a degree of reusability, with considerations around wear and tear that can take place on physically handled good.

SUMMARY

Embodiments relate to systems and methods for medication packaging, and in particular, embodiments relate to improving the accessibility, integrity and/or security of medications or drugs using a reusable packaging. The packaging can also prevent the drug items from dropping out or getting damaged. In some embodiments, the reusable packaging provides for ease of access by a user to their medications and reduces the effort and dexterity required for medication access. Embodiments further relate to a reusable packaging to reduce packaging waste. Embodiments also relate to systems and methods for medication packaging for protecting the integrity of the medications to help combat medication diversion problems. Diversions can happen at remote locations.

Embodiment described herein may reduce the amount of garbage and waste created by medication packaging while providing the consumer an easy way to access their medications. Embodiments described herein may allow the blister pack to be filled using machines built for this purpose. Embodiment described herein may have a method to support medication safety and/or integrity and as well prevent drug diversion from occurring.

Embodiment described herein provide a system of resealable packaging for holding medications. The system has a bottom element with one or more storage areas sized to contain one or more medication for consumption. The system has a top element of a corresponding size to the bottom element, the top element couples to the bottom element. The top element has one or more apertures to expose the one or more storage areas of the bottom element. The top element has a sliding middle section movable relative to the bottom element and the top element between a sealed closed position to cover the one or more apertures to seal the one or more storage areas of the bottom element and an open position to uncover at least one of the one or more apertures to expose the one or more storage areas and provide access to any medications contained therein. The system has a security seal that couples to the top element or the bottom element to limit the movement of the sliding middle component.

In some embodiments, the security seal is breakable to allow movement of the sliding middle section. Breakage of the security seal indicates access to at least one of the one or more storage areas.

In some embodiments, the sliding middle section is movable between the open position and the sealed closed position to cover the exposed one or more storage areas.

In some embodiments, the top element is coupled to the bottom element by an adhesive material.

In some embodiments, the top element has a receiving rail, wherein the top element is coupled to the bottom element by aligning the bottom element with the receiving rail on the top element and sliding the bottom element along the receiving rail.

In some embodiments, the bottom element slides along the receiving rail to uncouple from the top element for the reuse of the top element and the bottom element.

In some embodiments, the security seal covers a pull tab for the sliding middle section.

In some embodiments, the security seal connects to the top element and the bottom element.

In some embodiments, the security seal is a tear tab that physically connects the sliding middle to one of the top element and the bottom element.

In some embodiments, the security seal is an adhesive material that connects the sliding middle with the stationary top element or bottom element.

In some embodiments, the system has a second security seal between the top element and the bottom element to restrict the sliding movement of the top element and the bottom element and wherein the second security seal is breakable to permit movement and indicate tampering.

In some embodiments, the sliding middle section is a single piece of movable material.

In some embodiments, the one or more storage areas are arranged in one or more rows of storage areas, wherein the sliding middle section comprises a plurality of subsections corresponding to the one or more rows of storage areas located in the bottom element.

In some embodiments, the one or more storage areas are arranged in one or more columns of storage areas, wherein the sliding middle section comprises a plurality of subsections corresponding to one or more columns of storage areas located in the bottom element.

In some embodiments, the top element and the sliding middle section comprise one or more elements at designated locations that increase friction of the sliding middle section when moving relative to the bottom element and the top element between the closed position and the open position.

In some embodiments, the elements at the designated locations are for the exposing of the one or more storage areas through the one or more apertures of the middle section.

In some embodiments, the top element and the sliding middle section include an end-stop element that stops the sliding middle section from being fully removed from the top element.

In some embodiments, the top element has an identification tag indicating the provisioning of the packaging and one or more dose specific identification tags related to medication consumption.

In some embodiments, the system has an identification tag to indicate the reception of medications and one or more identification tags to indicate that the sliding middle section has moved to expose the one or more storage areas.

In some embodiments, there is provided a system of resealable packaging having a bottom element with one or more storage areas. The packaging has a top element of a corresponding size to the bottom element. The top element couples to the bottom element. The top element has one or more apertures to expose the one or more storage areas of the bottom element. The top element has a sliding middle section movable relative to the bottom element and the top element between a sealed closed position to cover the one or more apertures to seal the one or more storage areas of the bottom element and an open position to uncover at least one of the one or more apertures to expose the one or more storage areas. The system has a security seal that couples to the top element or the bottom element to limit the movement of the sliding middle component. In some embodiments, the sliding middle section is movable between the open position and the sealed closed position to cover the exposed one or more storage areas.

The top element and the sliding middle section can have one or more elements that increase friction of the sliding middle section when moving relative to the bottom element and the top element between the closed position and the open position.

In some embodiments, the top element has a receiving rail, wherein the top element is coupled to the bottom element by aligning the bottom element with the receiving rail on the top element and sliding the bottom element along the receiving rail.

In some embodiments, there is provided a method of using resealable packaging having a bottom element with one or more storage areas and an access top element.

The method involves filling the bottom element with one or more distinct and separate storage areas with one or more drugs such that the filled one or more distinct and separate storage areas correspond to dosing periods for the one or more drugs.

The method involves coupling the access top element to the bottom element, the access top element having a middle section covering the one or more storage areas of the bottom element so that the one or more drugs in the one or more storage areas are covered, the middle section moveable to expose or uncover at least one of the one or more storage areas.

The method involves attaching a security seal, wherein the security seal is breakable to indicate that the access top has been used to access one or more of the drugs held within the one or more storage areas.

BRIEF DESCRIPTION OF DRAWINGS

The following detailed description of the invention is better understood when read in conjunction with the included figures. The included figures are intended to illustrate one implementation of the invention for one skilled in the art. These exemplary illustrations are not intended to limit the disclosure to the specific embodiments shown herein.

DETAILED DESCRIPTION OF DRAWINGS

Embodiments described herein provide a system for improved accessibility of medication packaging using a bottom drug holder and a top enclosing element, providing options for reusability.

Embodiments further disclose how the bottom element has one or more storage areas sized to contain one or more medications for consumption by a consumer or user. The consumer could be the person consuming the medication or another person helping the medication consumer when they are too frail or infirmed to even access the medication in the packaging mechanism.

Embodiments further disclose how a top element of a corresponding size to the bottom element can be used and coupled together. Further, the top element has one or more apertures to expose the one or more storage areas in the bottom storage areas.

Further disclosed are various embodiments showing how the top element has a sliding middle section that covers the one or more apertures to seal the one or more storage areas. The sliding middle section is also movable relative to the bottom element. When the top element moves from a closed position to an open position, it uncovers at least one of the one or more apertures to expose the one or more storage areas to provide access to any medications contained therein.

Further elements provide various embodiments for using a security seal to couples to the top element to limit the movement of the sliding middle component. When the security seal is broken, it allows movement of the sliding middle section, wherein the breakage indicates access to the one or more of the storage areas.

Figure 1:
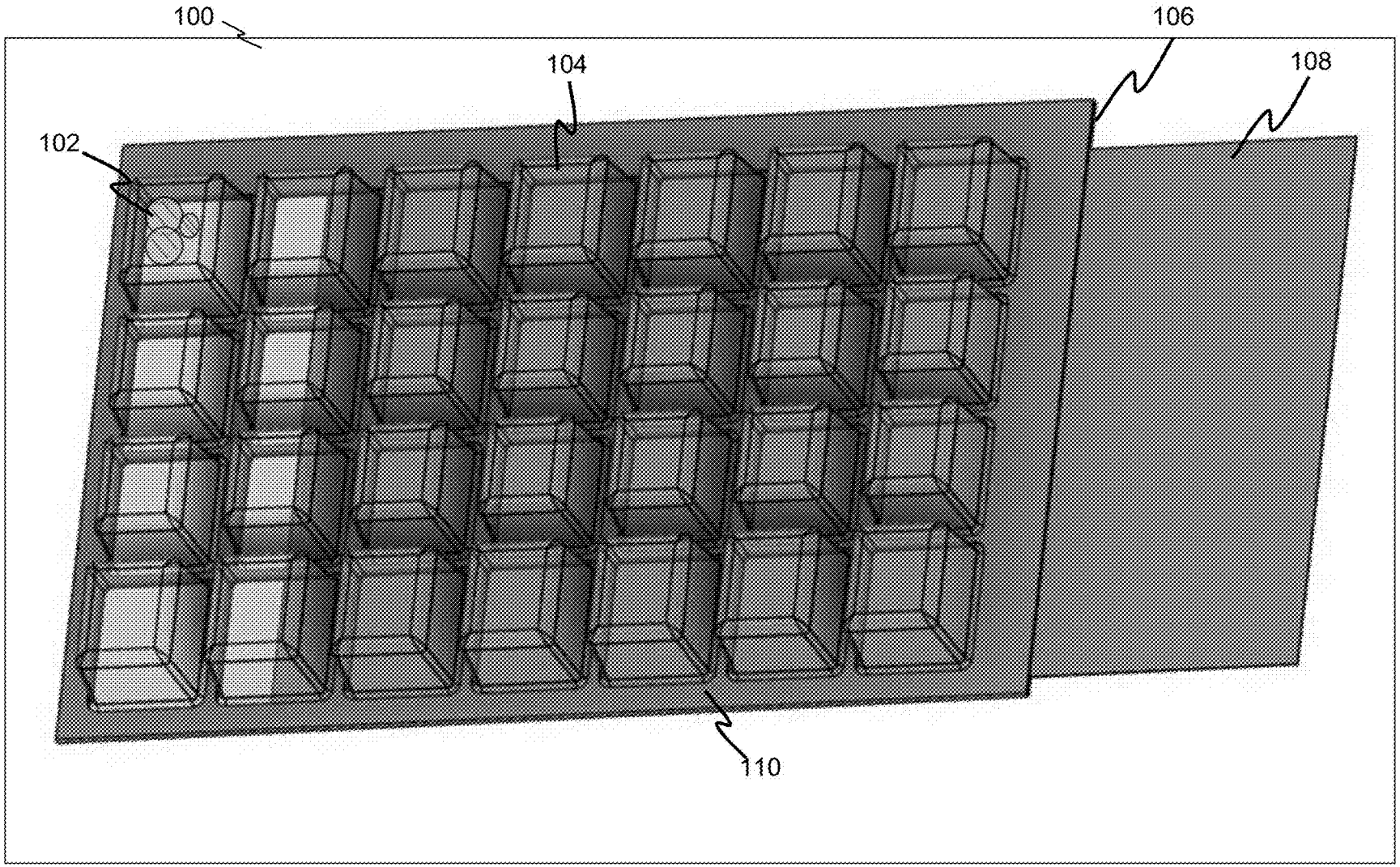
FIG. 1 is an illustration showing an overview of the packaging mechanism from a bottom perspective.

Moving to FIG. 1 there is an illustration showing an overview of the packaging mechanism 100 from a bottom perspective. The illustration depicts the one or more storage areas 104 that contains one or more types of medications 102. The number of storage areas illustrated is 28, or 4 rows by 7 columns. This is an example and there can be different configurations of rows and columns in various embodiments. Each of the storage areas can contain a set of medication items. The bottom element 110 is coupled with a top element 106 that has a sliding middle section 108. When it is pulled in this embodiment one or more of the storage areas are exposed through the corresponding aperture openings on the top element.

Although an embodiment is shown with this specific configuration of storage areas, it can be appreciated that there can be a number and variety of storage areas. For example, a smaller bottom element 110 might have fewer storage elements 104, perhaps just 6 storage areas 104 oriented in a single row. In another embodiment the bottom element 106 might have additional storage areas 104, for example 6 storage areas in a column and 7 rows, making a total of 42 storage areas 104.

The illustration also highlights the ability to pull the sliding middle 108 to different lengths to expose repeated different columns of medications 102 held within different storage areas 104. The sliding middle 108 can move between an open position and a closed position to provide access to the medications 102 held within different storage areas 104. The sliding middle 108 can move between from the open position to the closed position to provide access to the medications 102 held within different storage areas 104, and then cover the exposed storage areas 104 by moving from the open position to the closed position.

This embodiment provides a single sliding middle 108 covering an entire column of medications 102. In other embodiments there could be a single sliding middle 108 across the bottom 110, covering an entire row of storage areas 104 at once.

Although the embodiment shows a left to right exposing of storage areas 104 with the pulling of the sliding middle 108, the exact opposite direction could also be used in other embodiments. For example, for cultures and languages other than English that have a strong right to left orientation, having a pull from the left which exposes storage areas 104 and drugs 102 starting on the right-side column might make far more sense to a consumer (or other user who accesses the medications from the packaging given my earlier comment) or for a machine that is working on behalf of a consumer to access the medications.

The term practised in this application can have several embodiments. In some embodiments one or more individuals perform actions directly on the packaging mechanism to gain access to the one or more medications held within it. In other embodiments the consumer does not directly act upon the packaging mechanism, but it is access by a machine that extracts the medications using various designs and approaches on behalf of the medication consumer. The term practised or practising the invention, can refer to various types and methods that could be used for accessing the medications held within the packaging mechanism.

The term consumer or medication consumer or user will be used to identify the person who has need of accessing and consuming the contents of the packaging mechanism. In some embodiments, this person might need assistance to access their medication 102. So there could be one or more persons involved in the practising different embodiments described herein.

In this application the term medications will refer to prescription drugs, illegal drugs, medications, supplements and many other things. In some embodiments the medications 102 might be prescription drugs 102 in the different forms. In some embodiments, they are hard capsules 102, round pills 102 or any shape or size medications. In other embodiments they could be vitamins, energy pills, homeopathic remedies or naturopathic remedies. In other embodiments there could be street drugs like opioids, benzodiazepines, hallucinogens, LSD, Mescaline, or other similar substances that are being placed into a blister packaging mechanism for safe and careful consumption for drug addicts.

This embodiment also provides great advantage in those embodiments where a professional, like a pharmacist, doctor, dentist, nurse practitioner or some other knowledgeable person is loading medications 102 into the storage areas 104. Since the sliding middle section 108 can be opened, as shown, the medications 102 can be visually examined before the sliding middle section 108 is returned to a sealed closed position.

Figure 2:
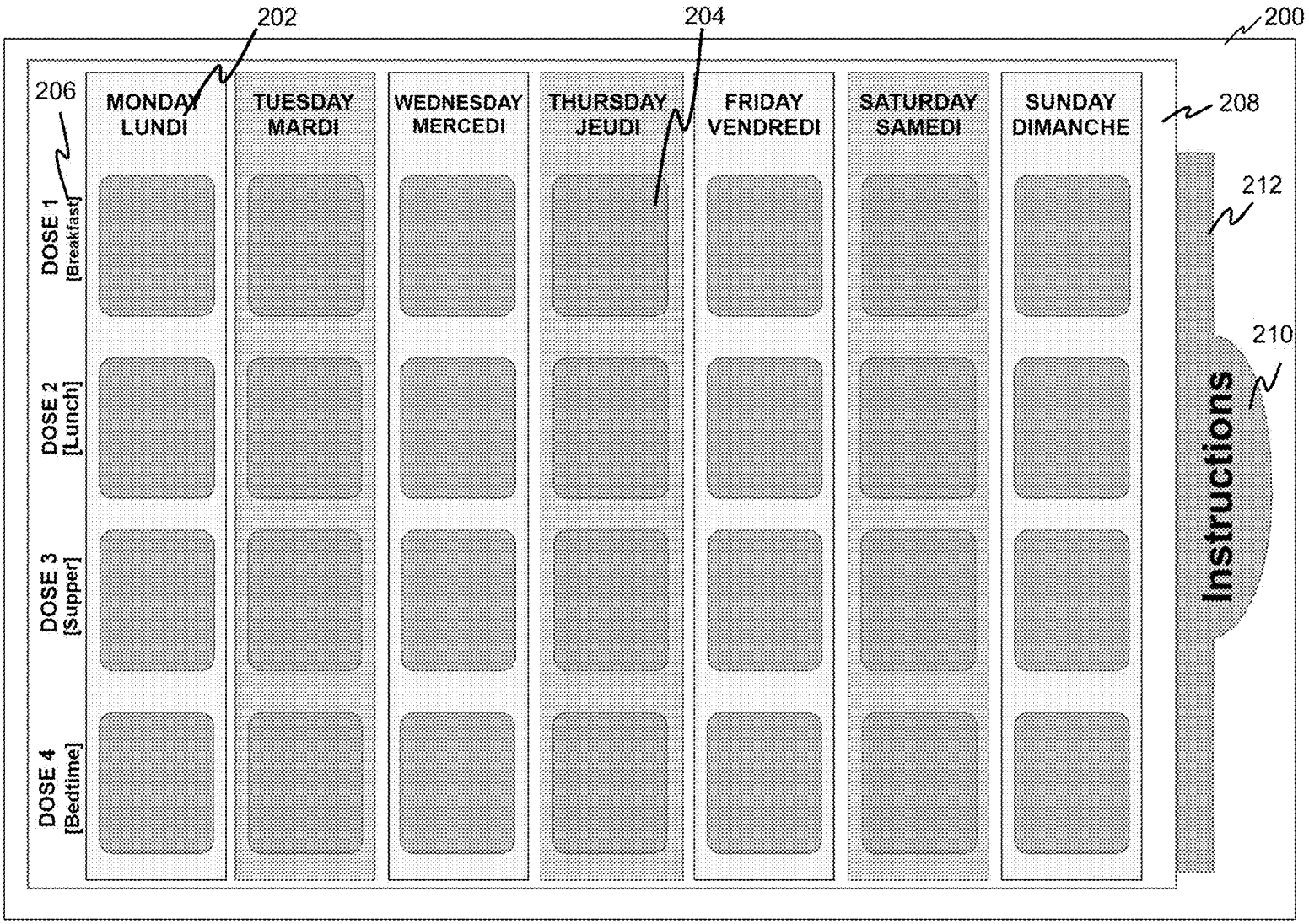
FIG. 2 is an illustration showing a top view of the packaging mechanism with a right-side orientation.

Moving to FIG. 2 there is an illustration showing a top view of the packaging mechanism 200 with a right-side orientation. The top view 200 shows some of the writing and words 202, 206 that can appear for the consumer for instructional and information purposes. Although a 4-dose per day regimen over 7 days has been shown, many other embodiments are possible. It could be possible to have embodiments providing 6 doses in a single day across 14 days and many other types of combinations.

In this embodiment the consumer is shown a week schedule starting on Monday 202 and ending on Sunday. Each day is shown as 4 doses, labeled Breakfast, Lunch, Supper and Bedtime 206. Additionally labeling shows, Dose 1, Dose 2, Dose 3 and Dose 4 to provide additional information to the consumer or the Pharmacist working with the packaging mechanism. The packaging can have different labels. In other embodiments and some of the figures to come there are other types of labeling shown. In yet other embodiments each of the aperture tops might be labeled with a medication name, or a day of the week for example.

The top element 208 is shown and 28 apertures 204 are represented currently blocked by the sliding middle section 212. The sliding middle 212 is shown as a single continuous sliding middle section, but other sliding middle sections are also possible. The sliding middle 212 can also have possible instructions 210 for a consumer to inform them the middle section much be slide outwards to expose medications.

Figure 3:
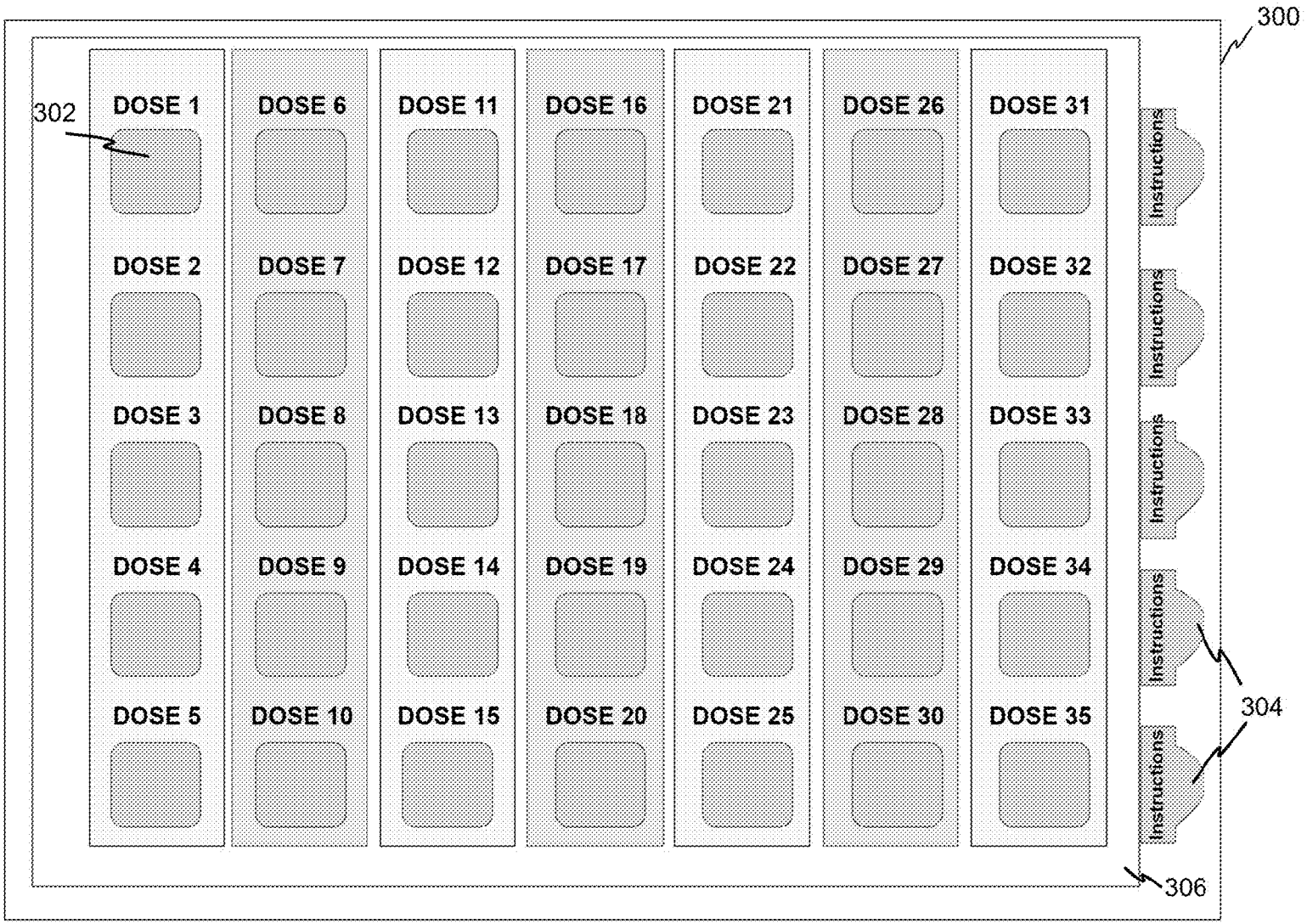
FIG. 3 is an illustration showing another embodiment of a top view of the packaging mechanism with a right-side orientation.

Moving to FIG. 3 there is an illustration showing another embodiment of a top view 306 of the packaging mechanism 300 with a right-side orientation. In this example the number of apertures 302 represented is 5 rows and 7 columns. This provides 35 doses of medication, which could be spread out 5 doses per day or 35 doses. In some embodiments these doses might contain vitamins and supplements, in other cases the doses are prescription drug medications spread out as prescribed by the health care practitioner. These can be referred to as medication or items.

In this embodiment there are 5 sliding middle sections 304, one for each of the five rows. This allows for a consumer to pull one individual sliding middle section following the instructions on the tab 304. By pulling one sliding middle a single aperture 302 would be exposed and reveal any medications contained in the bottom element's storage area.

Figure 4:
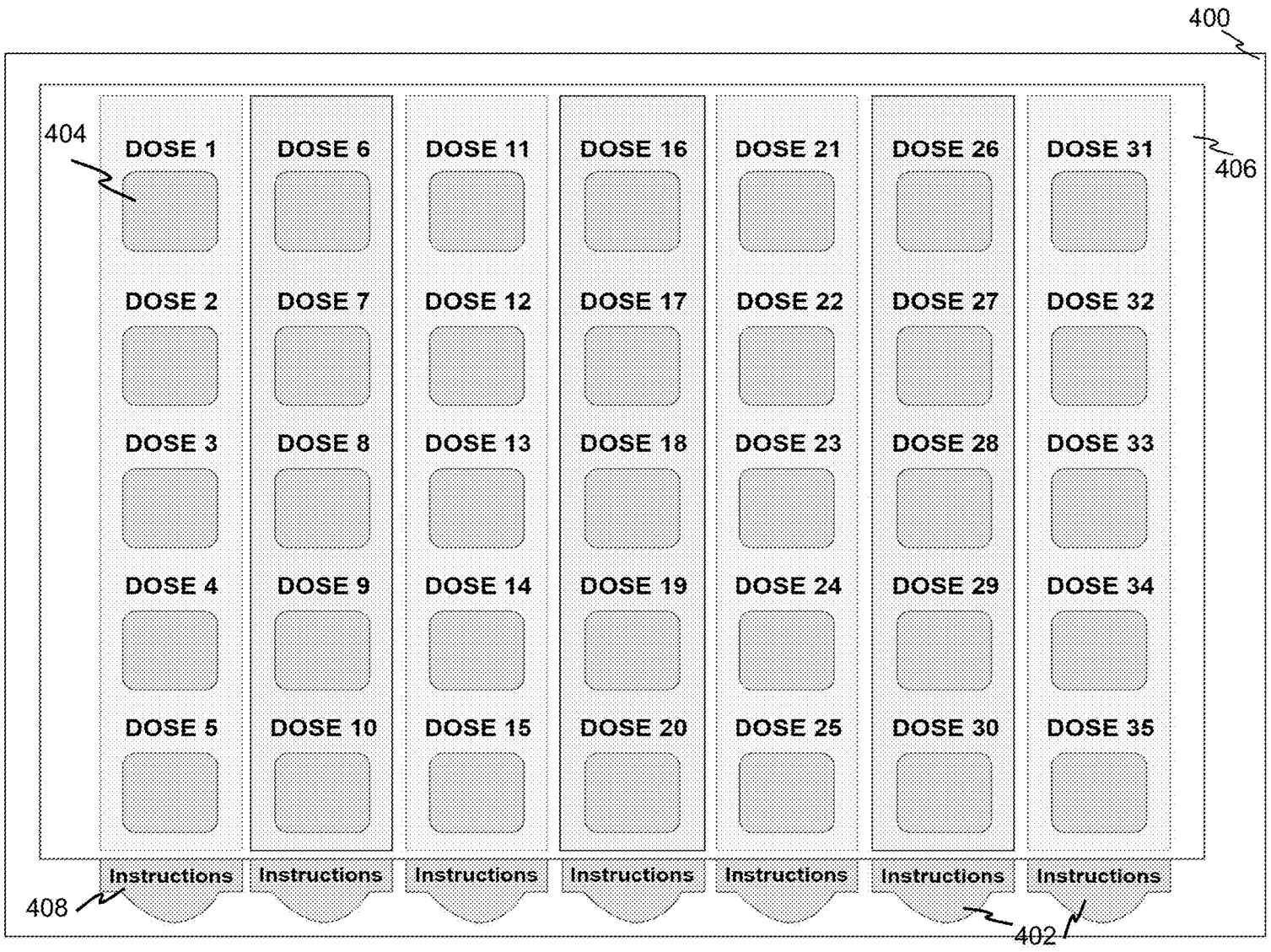
FIG. 4 is an illustration showing a top view of the packaging mechanism with a bottom orientation.

Moving to FIG. 4 there is an illustration showing a top view 406 of the packaging mechanism 400 with a bottom orientation. In this example the number of apertures 404 represented is 5 rows and 7 columns. This provides 35 doses of medication, which could be spread out 5 doses per day, or 35 doses spread out as desired or as prescribed by the health care practitioner. The items can be vitamins and prescriptions for different types of items can be written by other types of practitioners.

In this embodiment the sliding middle section 402 is divided into 7 sections, each section 402 aligned with one of the 7 columns. In those embodiments where the 7 columns represent a day of the week, it provides a convenient way to know whether one day's medications have been started or not. By pulling the first middle section 408 the first dose, Dose #1 (404) can be exposed.

In other countries where English is not used but a language or culture that reads from bottom to the top, it might be useful to change the direction of the sliding middle section 402. In other embodiments the direction of the sliding middle section 402 could be from the top, pulling upwards to expose the first dose of medication.

Figure 5:
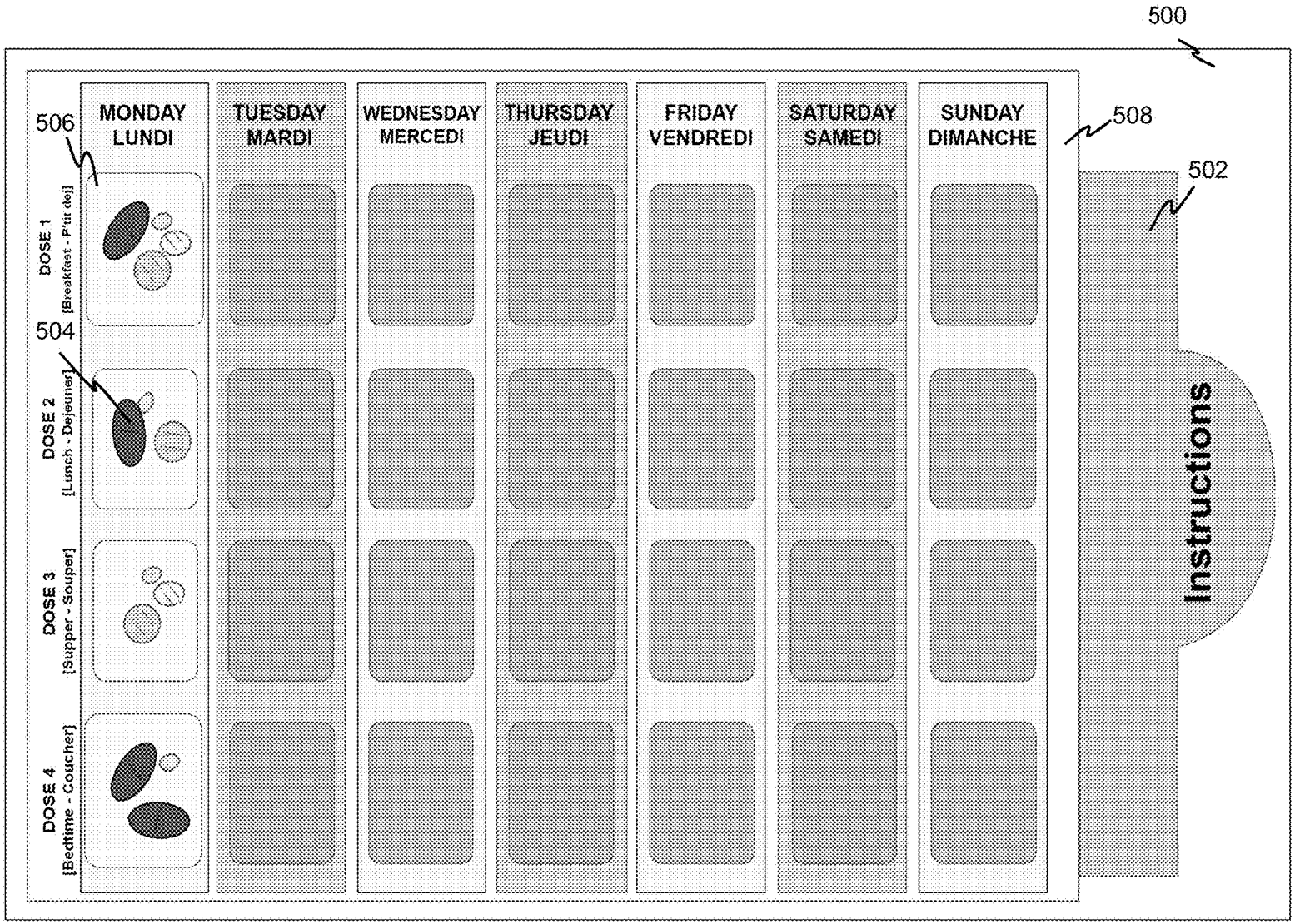
FIG. 5 is an illustration showing a top view with a right-side orientation with the middle section extended exposing drugs.

Moving to FIG. 5 there is an illustration 500 showing a top view with a right-side orientation with the middle section 502 extended exposing drugs 504. In this embodiment the consumer can expose an entire day's worth of medications when the middle section 502 is moved from a closed position to a partially open position. This might provide the ability to remove a full day's worth of medications 504 for travel or visiting purposes where the consumer intends to be out of the house for the day.

In other situations the ability to expose a single day or many days of drugs allows a health care practitioner to review exactly what has been placed into every storage area. For example, it is common practice within pharmacies that a pharmacist assistant will prepare medications for a consumer, but the licensed Pharmacist always performs a final check of the medications before physically signing off that a double-check has been performed. This sliding middle that can opened and then return to a sealed closed position allows for this double-checking of medications with a clear visual of the medications held within the storage areas.

In another example, it is also possible to completely open the entire middle section 502 to expose all storage areas 506 and transfer all the medications 504 from all the storage units 506 to another container. This alternative container might be used for long-term storage. It could be plastic for safety or storage, it could be a medication dispenser type product that receives the medications 504 once the middle section 502 is removed.

In some embodiments the alternative container might temporarily couple with the top element 508 to facilitate the transfer of the medication 504. Once transferred the alternative container might be capable of folding once or twice into a small size for travel. Alternative travel or movement containers might also be made of a very robust material to withstand travel, abuse. They could also have combination locks, key locks, biometric input capabilities and other specialized properties. The design of the single pieces sliding middle section allows the consumer to expose one, two, three or all rows of storage areas 506. The packaging with the sliding middle section allows the consumer to expose different containers of the storage areas 506 independently and separately. This capability makes it ideal for a wide range of uses.

Figure 6:
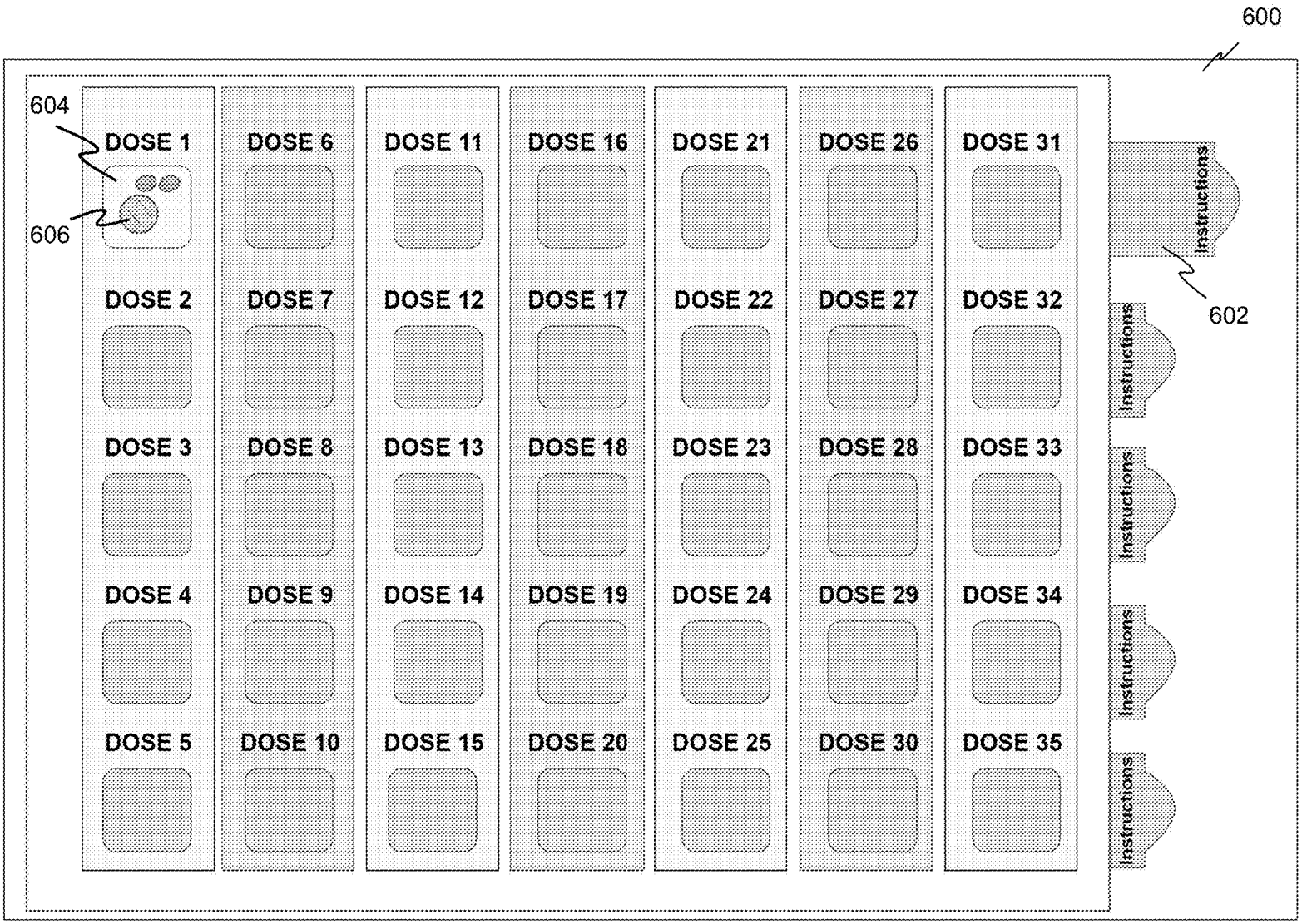
FIG. 6 is an illustration of a second embodiment showing a top view with a right-side orientation with one of the middle sections extended exposing drugs.

Moving now to FIG. 6 there is an illustration 600 of a second embodiment showing a top view with a right-side orientation with one of the middle sections 602 extended exposing drugs 606. This embodiment shows the versatility of the solution and provides another method for the consumer to slowly expose the medications for consumption. The convenience of the solution means that the consumer no longer must cut, break or tear into the section to break through into the bottom medication storage areas. This ease of use is very important in cases where the consumer has physical limitations, strength or dexterity challenges.

Another advantage of exposing a single storage area 604 is the consumer can now tip the packaging mechanism over top their hand and the medications 606 will fall easily into their palm. This avoids problems of fishing the medications out of a storage area and having them fall onto the ground.

Providing the ability to move partial amounts of the middle section 602 provides the safest and easiest way to access one of the many storage areas 604 located in the bottom element. Moving the middle section 602 from a closed to partially open position gives the consumer or some person helping the medication consumer maximum control over how many drugs 606 are exposed at any one time. Returning the middle section 602 back to a sealed closed position means all the remaining medications remain safe from exposure.

Figure 7:
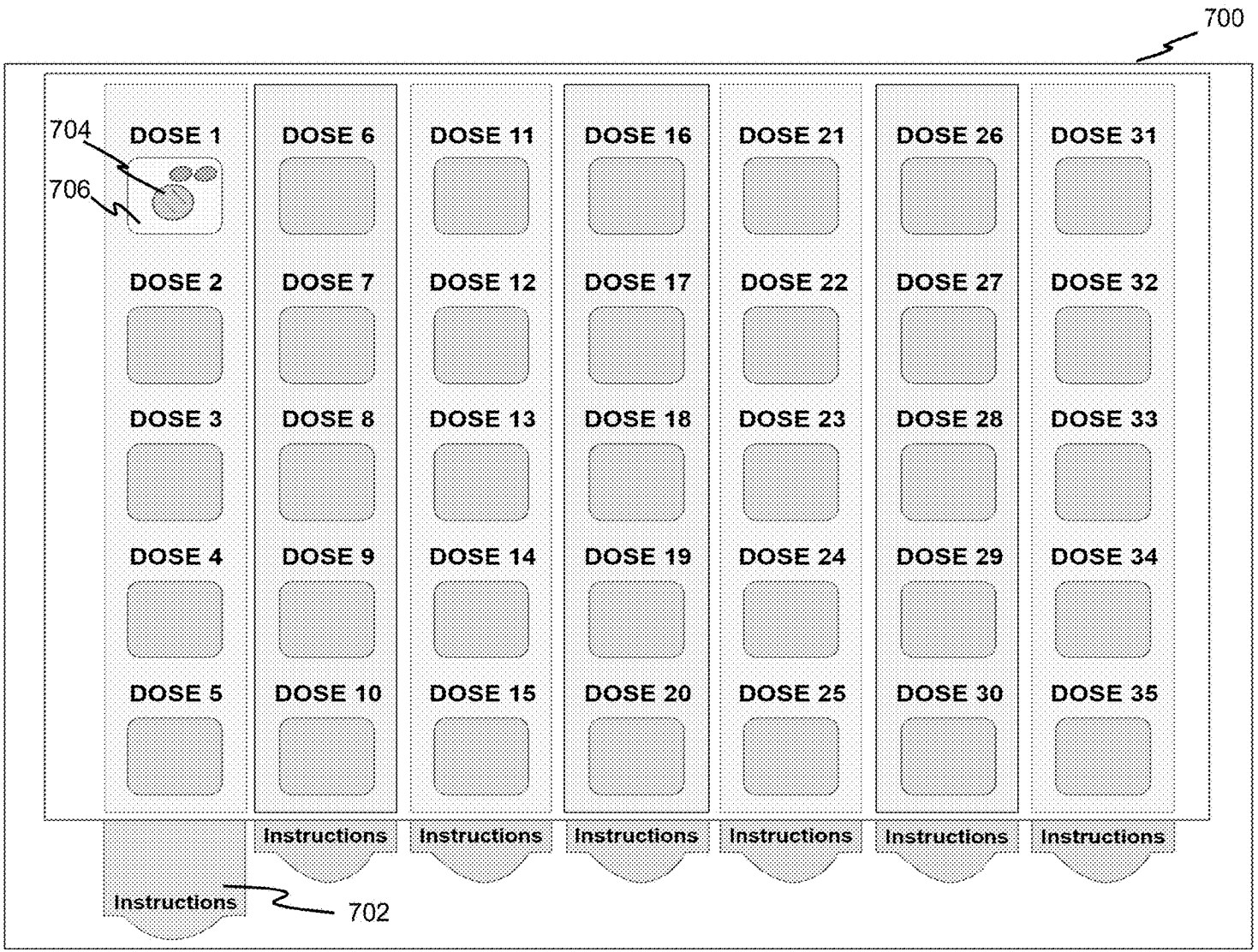
FIG. 7 is an illustration showing a top view with a bottom orientation with one of the middle sections extended exposing drugs.

Moving now to FIG. 7 there is an illustration 700 showing a top view with a bottom orientation with one of the middle sections 702 extended exposing medications 704. In this alternative embodiment the consumer can pull just one of the 7 sliding middle sections 702 to expose medications for a single column. In those embodiments where the column represents the doses available in a single day, this provides a convenient approach to progressively expose the medications for a single day.

Figure 8:
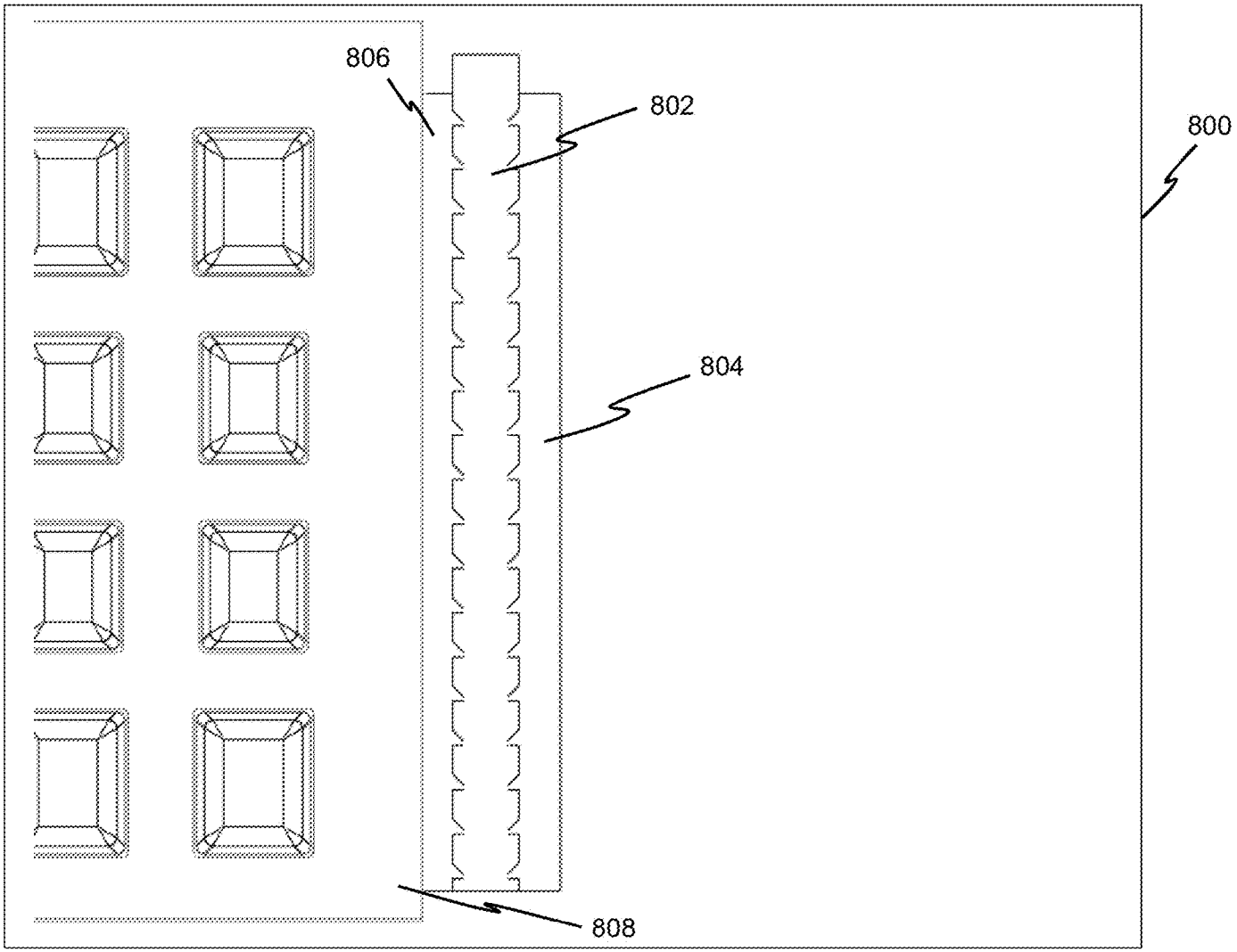
FIG. 8 is an illustration showing a bottom view of one embodiment for a security seal for the packaging mechanism.

Moving to FIG. 8 there is an illustration 800 showing a bottom view of one embodiment for a security seal 802 for the packaging mechanism 800. In this embodiment the security seal is a pull tab or a tear tab 802 that connects the middle sliding section 804 to the stationary top section 806. The stationary top section 806 that is narrowed to match the sliding middle 804 is also connected to a larger stationary section 808 that couples to the bottom section holding the drugs in separate storage areas.

In the process of tearing the tab 802 the middle section 804 is freed from the stationary top section 806 thus allowing it to move freely. Tearing the tab also indicates that someone has accessed the medications and that could be an indication that something is not right for the consumer.

Figure 9:
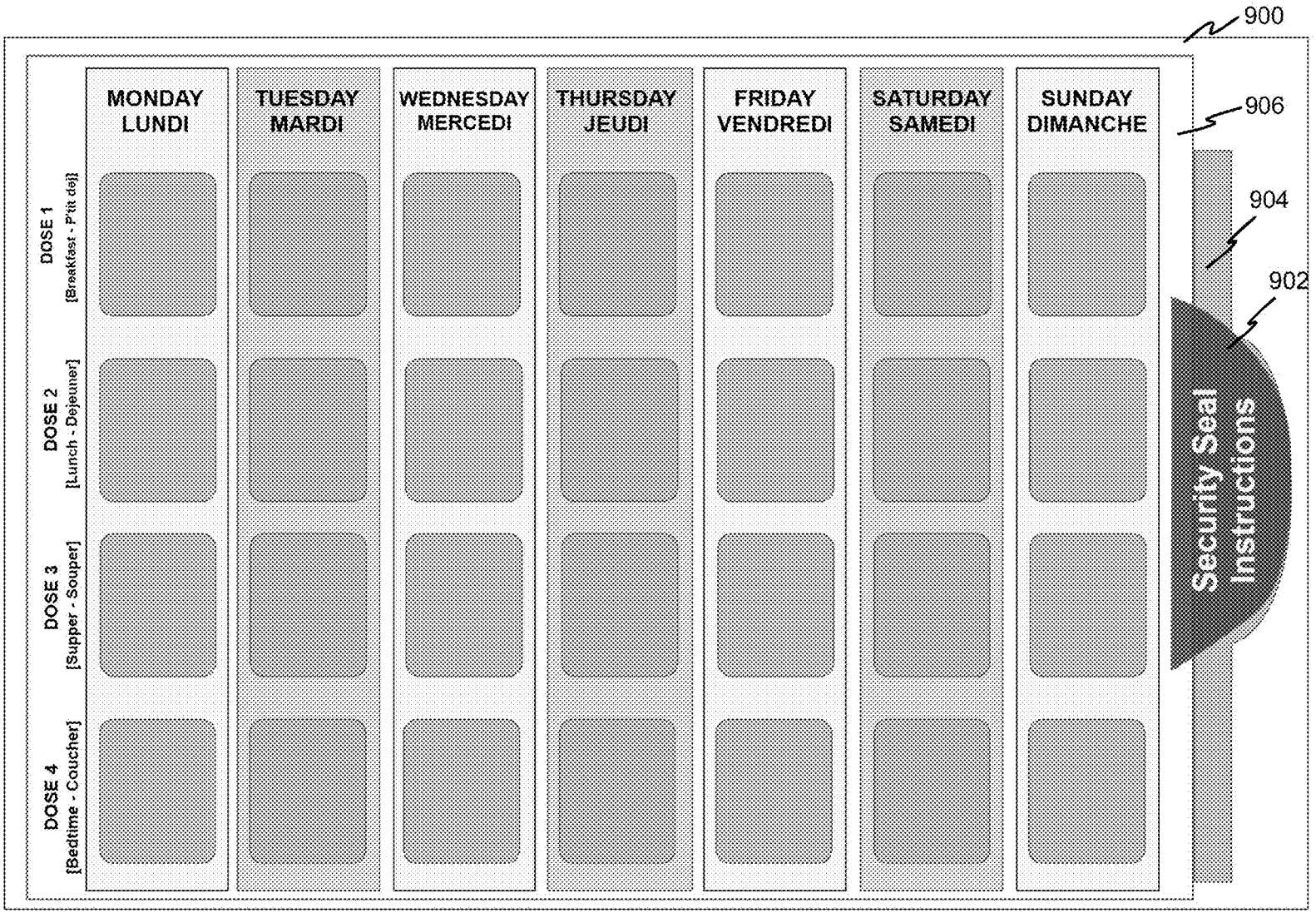
FIG. 9 is an illustration showing a top view of another embodiment for a security seal for the packaging mechanism.

Moving to FIG. 9 there is an illustration 900 showing a top view of another embodiment for a security seal 902 for the packaging mechanism. In this embodiment the security tab 902 can be a flap, a piece of tape or something with adhesive qualities to connect the sliding middle section 904 to the stationary top element 906. In those embodiments where an adhesive tape is used, the moment the tape is removed, touched or adjusted it is no longer able to adhere to the surfaces. This property allows the detection of whether someone has already tampered with the medications or accessed the sliding middle 904 for some nefarious reason.

This embodiment for a security seal 902 does has the advantage of being easy to manufacture and allows a health care practitioner (often performed by a "Pharmacist") to apply the security seal 902 after they have examined the contents of the bottom element's storage containers to confirm the exact medications in each of them. Reducing errors and mistakes in prescription medication distribution is fundamentally important for reducing hospitalizations and reducing health care costs.

Figure 10:
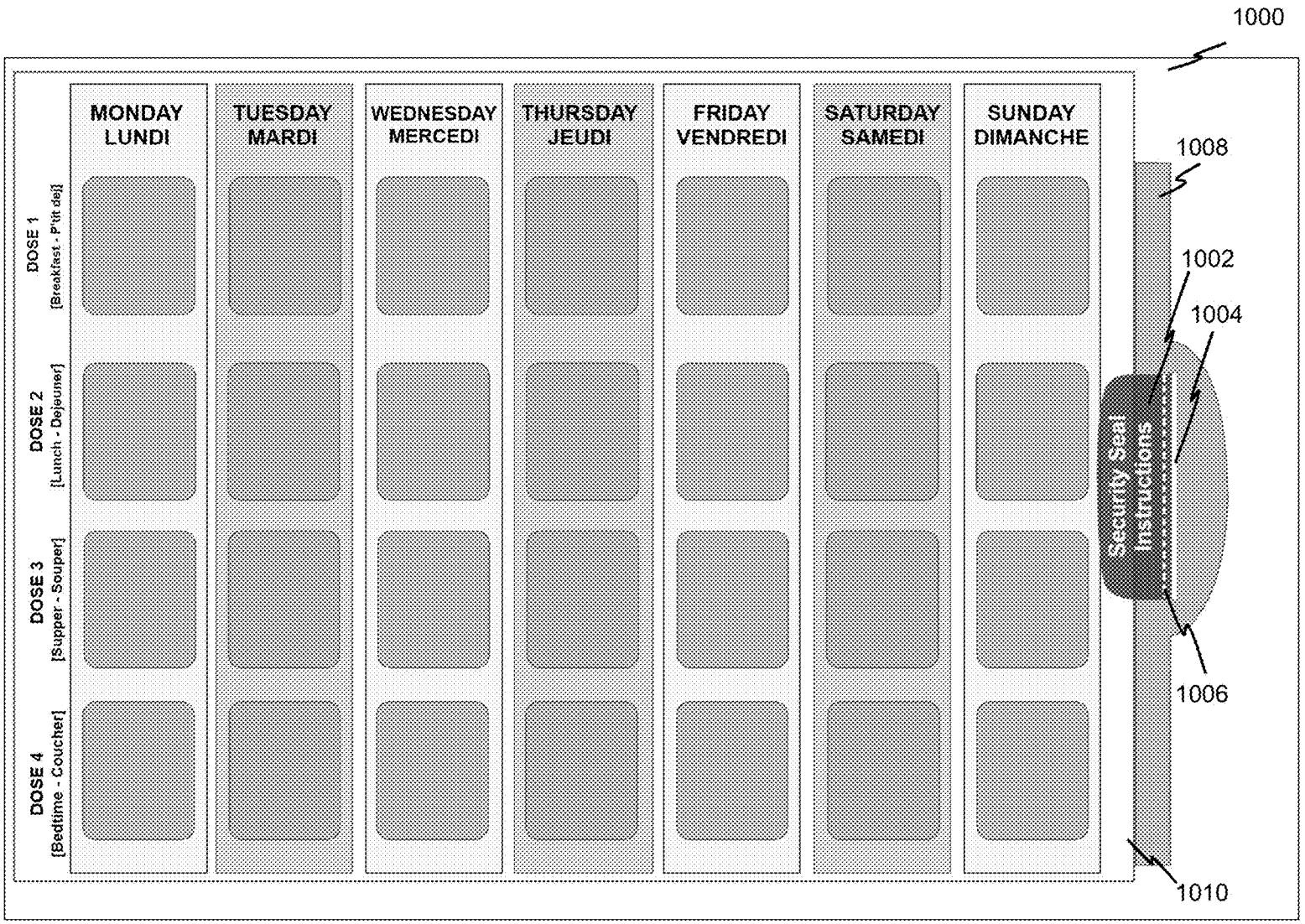
FIG. 10 is an illustration showing a top view of another embodiment for a security seal for the packaging mechanism.

Moving now to FIG. 10 there is an illustration 1000 showing a top view of another embodiment for a security seal 1002 for the packaging mechanism. In this embodiment the security seal 1002 passes through a gap 1004 in the sliding middle section 1008. The security seal 1002 then adheres to the stationary top element 1010 and the bottom element. In this embodiment the adherence can be extremely strong as there is a perforation 1006 that provides a tearing action when the sliding middle section 1008 is pulled away from the stationary top element 1010.

This embodiment has the advantage of being very detectable when the tape, boxboard or other adhesive material has been damaged in the process of removing the sliding middle section 1008. In those embodiments where the security seal 1002 is an adhesive tape product, a health care practitioner can also apply this and feed it through the sliding middle section 1008 just after they have double-checked the contents of each storage area and before delivering it to the consumer.

Figure 11:
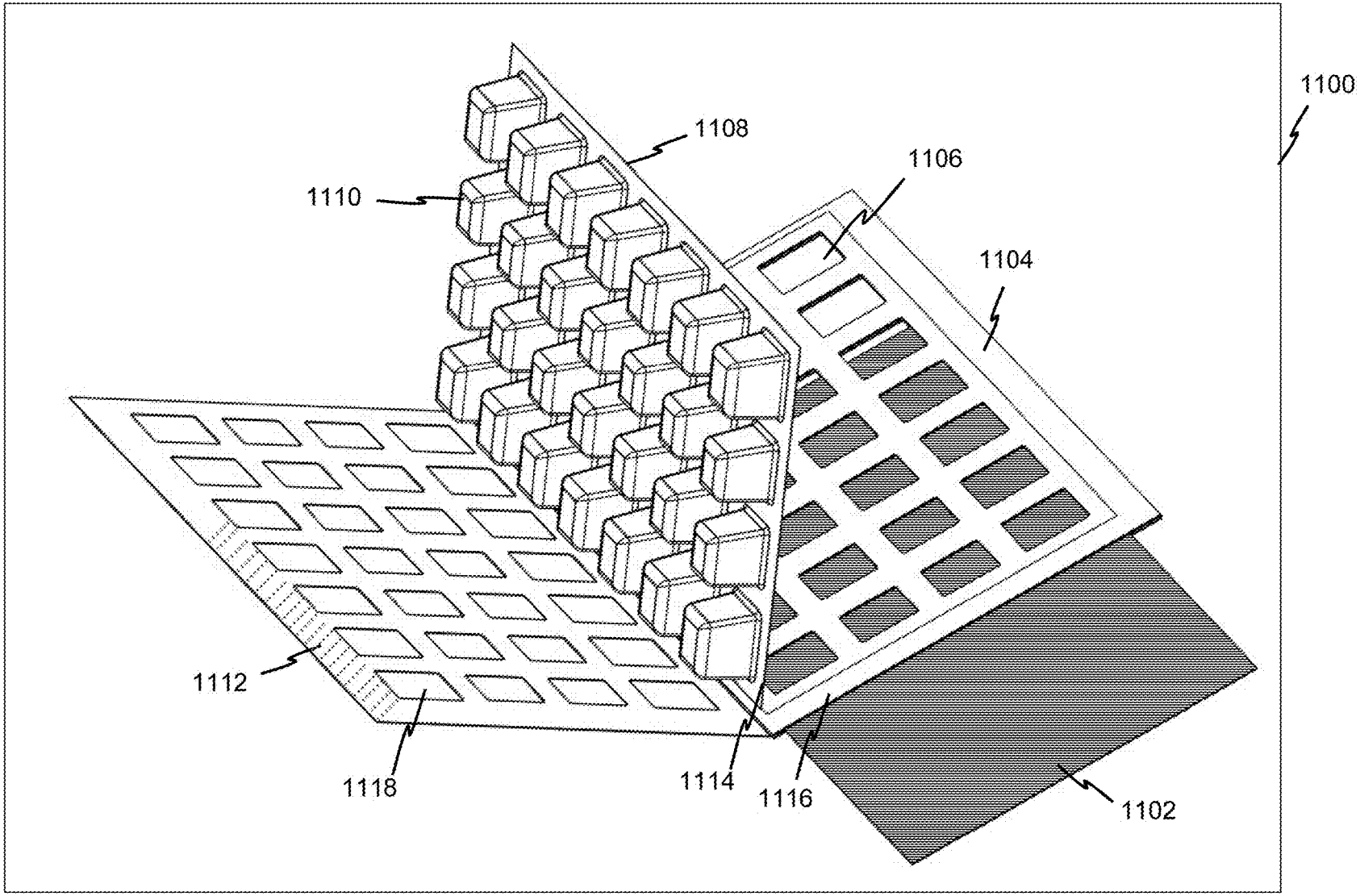
FIG. 11 is an illustration of a broken-out view of the unconstructed elements for one embodiments of the packaging mechanism.

Moving to FIG. 11 there is an illustration 1100 of a broken-out view of the unconstructed elements for one embodiments of the packaging mechanism. This broken out view is provided to show how a pull tab or tear tab could be used to connect a sliding middle section 1102 with a stationary top element 1104.

In this illustration the sliding middle section 1102 is able to move freely in the stationary top section 1104. The top element apertures 1106 are blocked once the sliding middle section 1102 is moved into a closed position. The illustration depicts the sliding middle section 1102 in a partially closed position with one- and one-half columns exposed 1106.

The bottom element 1108 with its storage containers 1110 is placed on top of the stationary top element 1104 which matches its size and shape. There are several embodiments to complete the coupling. In one embodiment the top element 1104 slides onto the bottom element 1108. This embodiment is highlighted in subsequent figures.

In another embodiment, as shown in FIG. 11, the top element 1104 is coupled to the bottom element 1108 using an adhesive layer 1112. The adhesive layer 1112 is built with a solid backing and a top surface 1112 that is an adhesive material that has been affixed to the solid backing. This has been partially represented with short dashed lines 1112. In this example, an adhesive layer 1112 is placed over the edges 1114 of the bottom element 1108. After meeting the edge 1114 of the bottom element 1108, the adhesive layer 1112 then meets the edges 1116 of stationary top element 1104. The adhesive layer 1112 is also constructed with apertures 1118 to ensure no adhesive 1112 touches the storage areas 1110 and they pass directly through the adhesive aperture holes 1118. This coupling method forms a bond with the bottom element 1108 to ensure a complete seal on all sides of the bottom element 1108 to keep out dust, air or any other contaminates.

Figure 12:
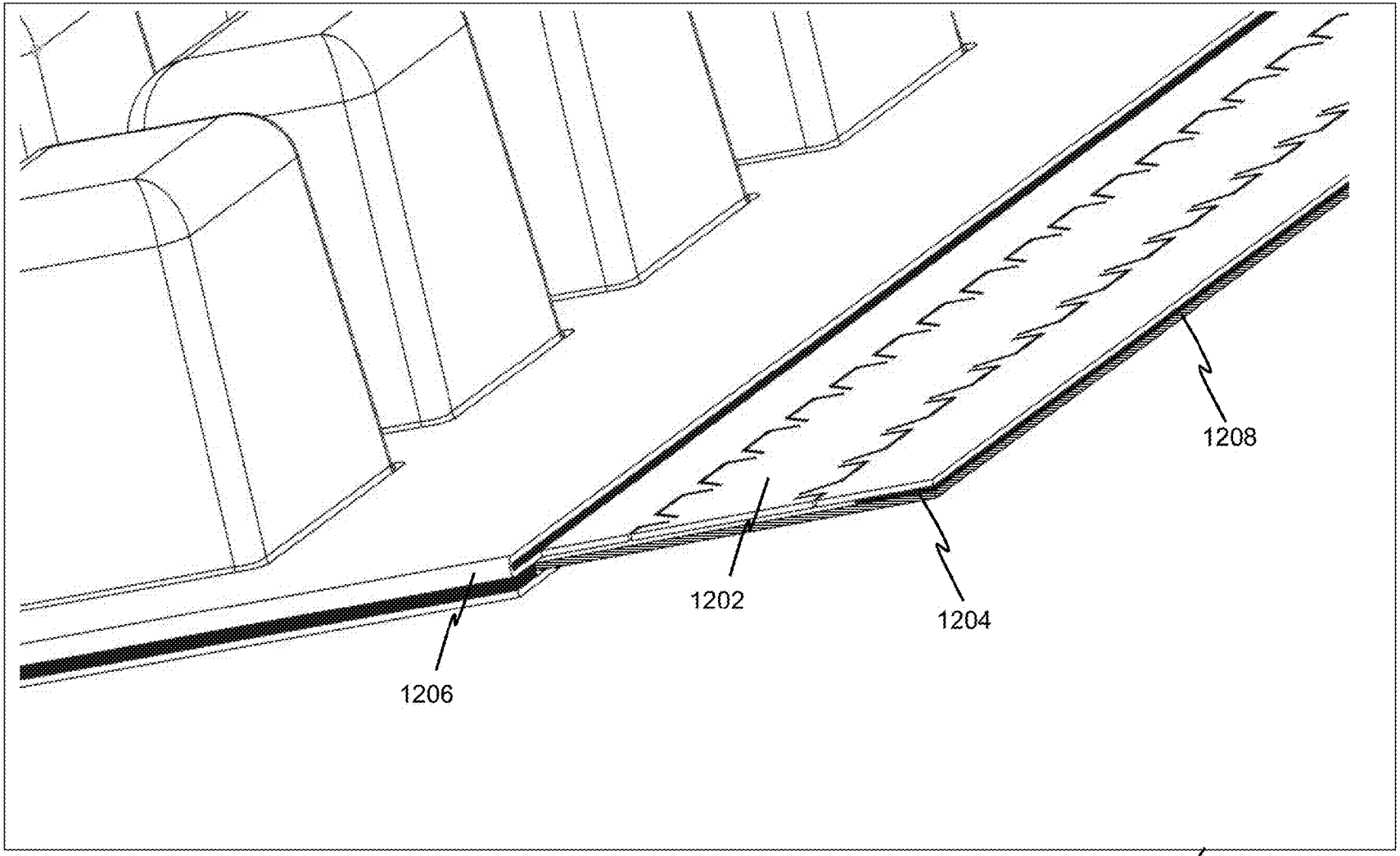
FIG. 12 is an illustration of a close-up view of one embodiment of how a security seal would be constructed for the packaging mechanism.

Moving to FIG. 12 there is an illustration 1200 of a close-up view of one embodiment of how a security seal 1202 would be constructed for the packaging mechanism. This embodiment shows a security seal 1202 as a tear away tab 1202 and how it couples 1204 to the stationary bottom element 1206 to form a security seal 1202 that can be manufactured. By placing a small seam (dark black) of adhesive 1204 between the stationary bottom element 1206 and the sliding middle section 1208 (dashed line) the sliding middle 1208 will not move until the tear tab 1202 has been torn away.

Figure 13:
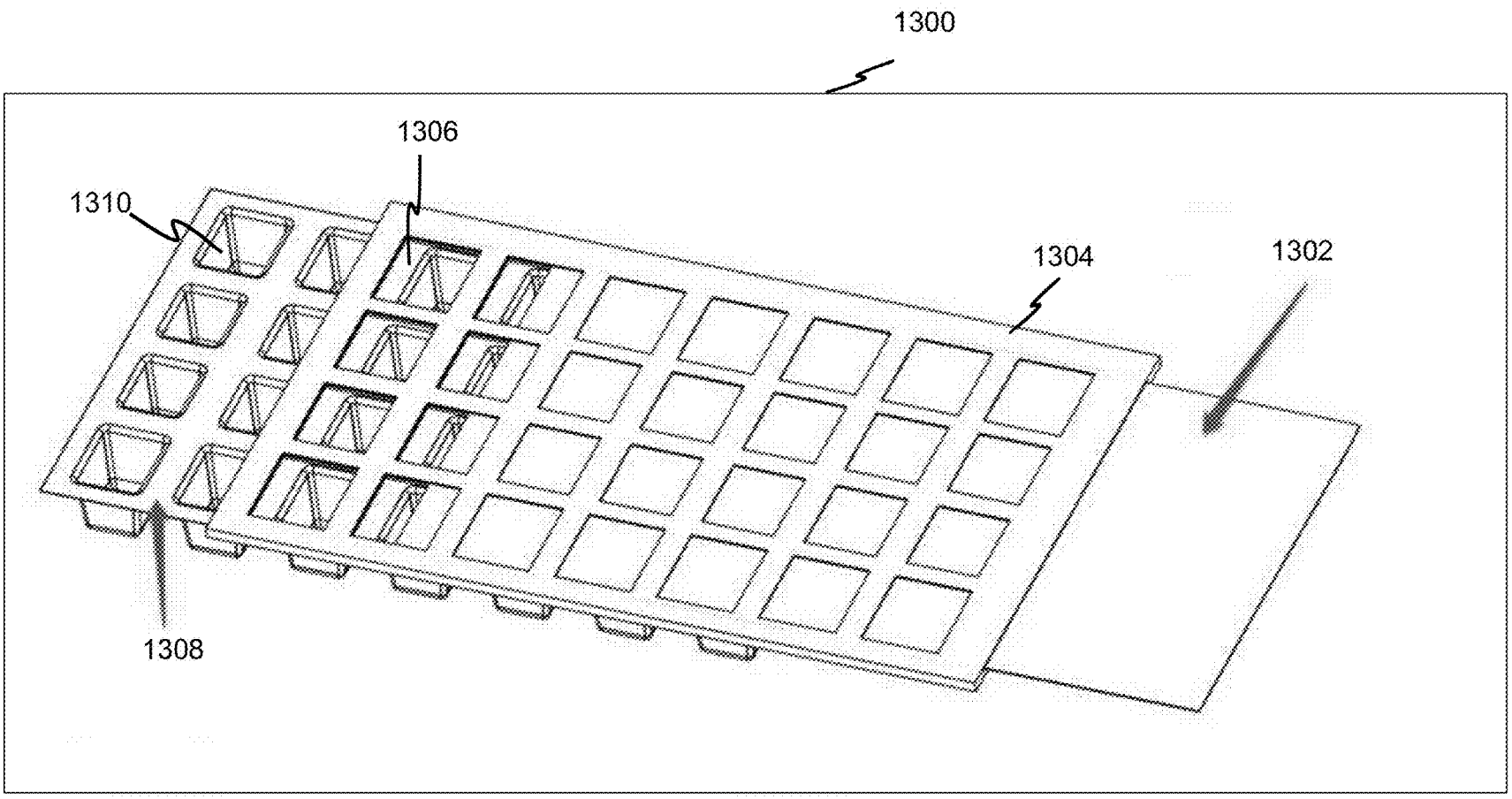
FIG. 13 is an illustration showing a top view of one embodiment for a reusable method for the packaging mechanism.

Moving to FIG. 13 there is an illustration 1300 showing a top view of one embodiment for a reusable method for the packaging mechanism. In this illustration the sliding middle 1302 is shown as partially pulled from the top element 1304. The partial movement has exposed several bottom element 1308 storage areas 1310 through the matching top element apertures 1306. Also illustrated is how the entire top element 1304 can slide onto the bottom element 1308. This action has exposed an entire part of the bottom element 1308 including one and one-half columns of storage areas 1310.

In this embodiment the top element 1304 and bottom element 1308 are independently reusable and can be rejoined at a later date for reuse. In one embodiment the user of the packaging mechanism realizes that the top element 1304 is okay but there is a tear in the bottom element 1308. The user is then able to return the top element 1304 and the health care practitioner is able to find a brand new bottom element 1308 that matches the top element's 1304 size and shape to form a new coupled packaging element.

Figure 14:
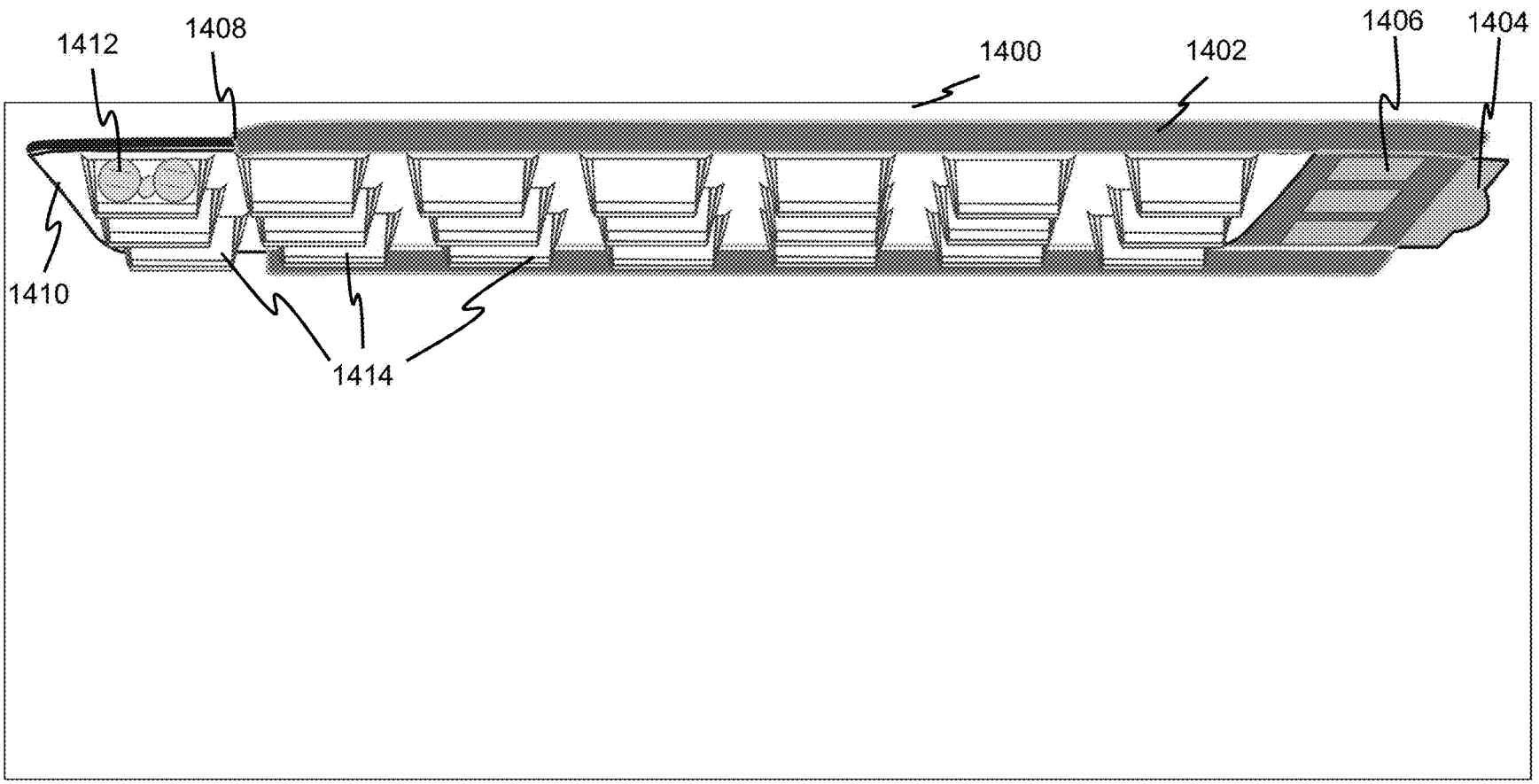
FIG. 14 is an illustration showing a side view of one embodiment for a reusable method for the packaging mechanism.

Moving to FIG. 14 there is an illustration 1400 showing a side view of one embodiment for a reusable method for the packaging mechanism. In this embodiment the reusable top element 1402 is shown as sliding onto the bottom element 1410. As the top element 1402 slides on the various apertures 1406 line up with the storage areas 1414 within the bottom element 1410. The leading edge 1408 of the top element 1402 is engineered to have an indentation wide enough to allow the bottom element 1410 to slide within the sides of the top element 1402 to form a seal for reusability.

Once the top element 1402 is complete covering the bottom element 1410 and all storage areas 1414 with medications 1412 contained within are covered over, the two units are considered coupled. A health care practitioner can then apply a security seal, several of which were disclosed, and the prepared medication packaging can be delivered for use.

Figure 15A:
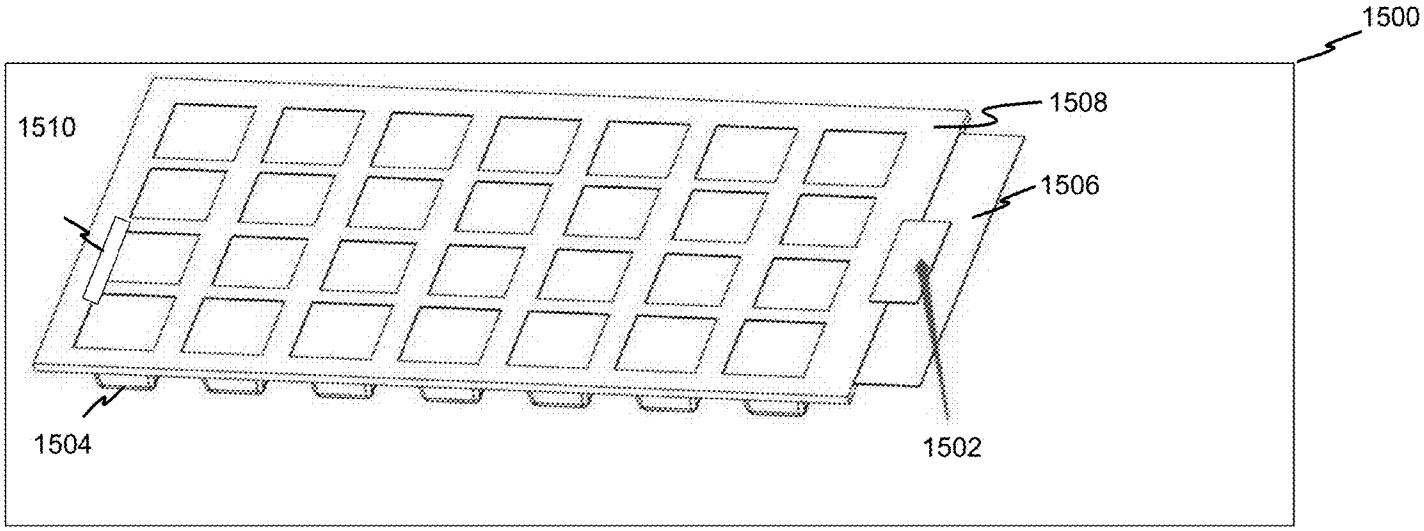
FIG. 15A is an illustration of another top view of one embodiment for a reusable method for the packaging mechanism.

Moving now to FIG. 15A there is an illustration 1500 of another top view of one embodiment for a reusable method for the packaging mechanism. In this illustration the security seal has been added once the medications are loaded into the various storage areas 1504. The sliding middle section 1506 is in a fully closed position and by adding the security seal 1502 the sliding middle section 1506 cannot be moved without detection.

To ensure full security an additional security seal 1510 is required. This second security seal 1510 ensures the sliding top element 1508 cannot be moved which out detection.

Figure 15B:
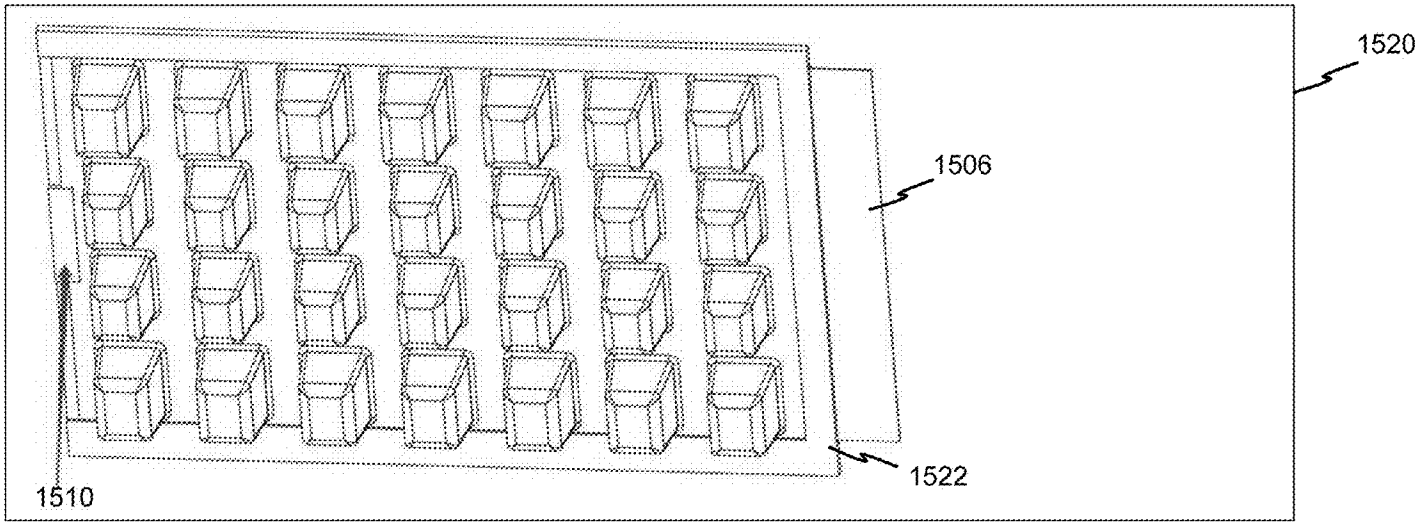
FIG. 15B is an illustration of a bottom view for FIG. 15A showing one embodiment for a reusable method for the packaging mechanism.

Moving now to FIG. 15B there is an illustration 1520 of a bottom view of FIG. 15A showing an embodiment for a reusable method for the packaging mechanism. In this illustration 1520 the sliding middle section 1506 is in a fully closed position as highlighted in FIG. 15A. The security seal 1502 for the sliding middle 1506 has been engaged as shown in FIG. 15A. To ensure that tampering cannot take place with the sliding top element 1508 a second security seal 1510 is placed across the bottom element 1522 and curling around to connect to the top element 1508.

Figure 16:
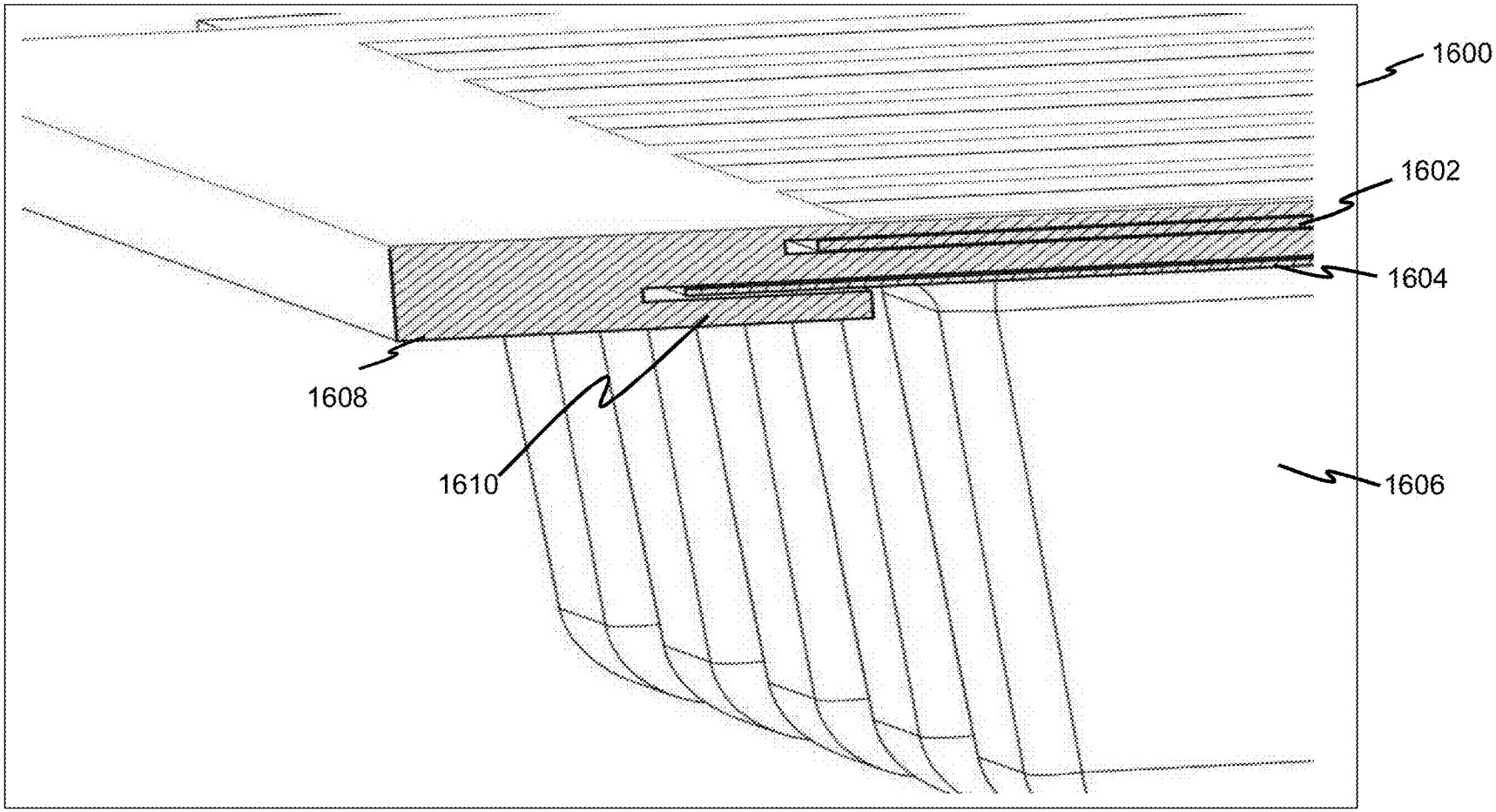
FIG. 16 is an illustration of a cross-section view of one embodiment for a reusable method for the packaging mechanism.

Moving now to FIG. 16 there is an illustration 1600 of a cross-section view of one embodiment for a reusable method for the packaging mechanism. The focus of the illustration is a cross-section of the top element 1608 showing multiple track sections 1602, 1604 to allow the sliding middle section 1602 and the bottom section 1604 slide freely through the top element 1608.

In this embodiment, the sliding design of the top element 1608 that allows the bottom element 1604 free movement includes an overhang lip 1610. This overhand lip 1610 allows the storage areas 1606 that protrudes downward and contain one or more medications. There are other embodiments that would be possible to enable this, including for example a clipping method of fashioning and coupling the top element 1608 and bottom element 1604. This example is not meant to limit other designs that allows for dynamic movement between the top element 1608 and bottom element 1604.

Figure 17:
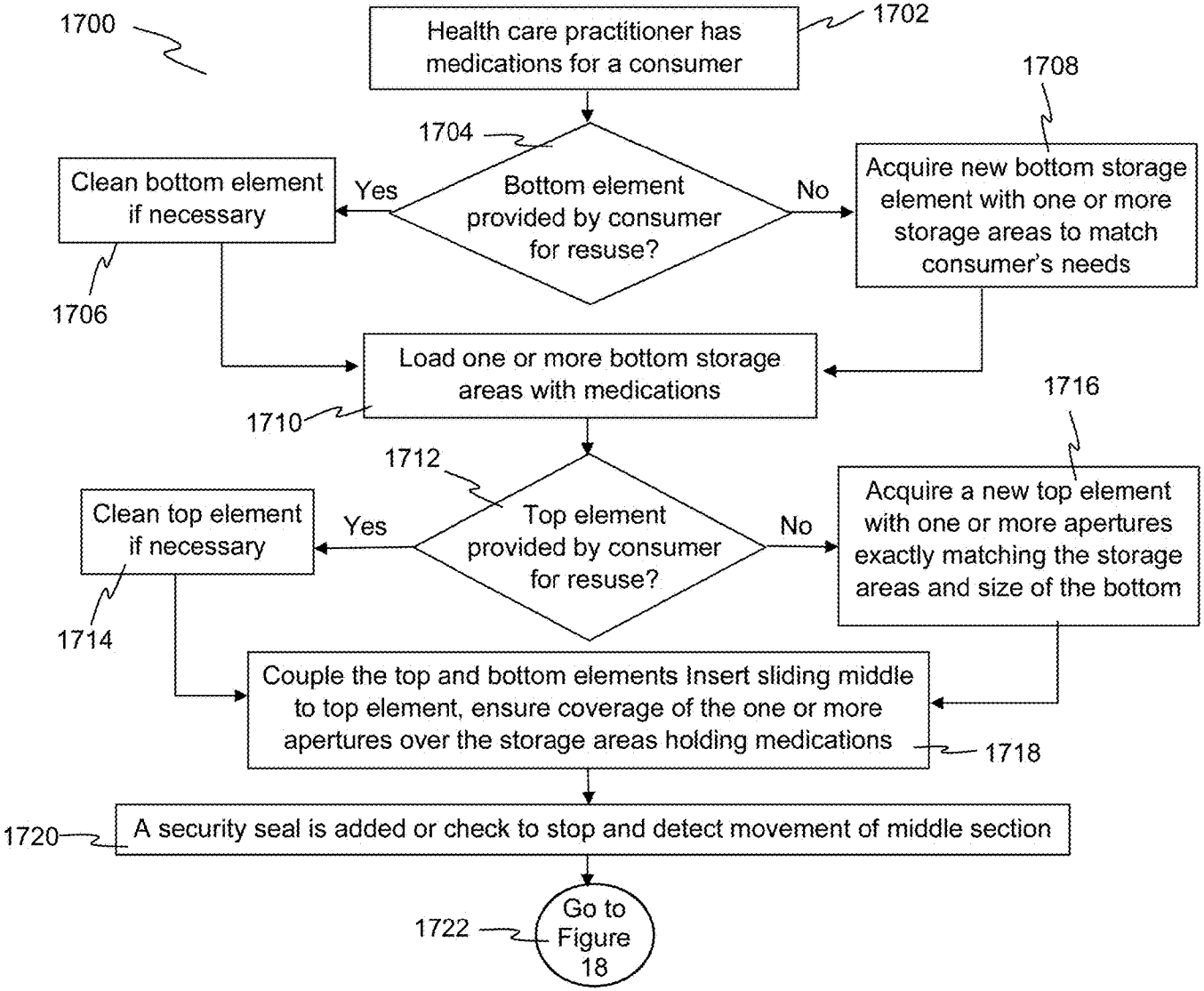
FIG. 17 is a data flow diagram illustrating one embodiment for preparing the packaging mechanism.

Moving now to FIG. 17 there is a data flow diagram 1700 illustrating one embodiment for preparing the packaging mechanism. There are many embodiments where the invention can be used and practiced. The embodiment provided is a common embodiment followed in most pharmacies in many countries. Other embodiments could include medications provided through a hospital, medication provided in a doctor's office, dentist's office, by a nurse practitioner. There are also embodiments where medications are dispensed in a long-term care home or senior residence and many other.

In this embodiment a health care practitioner has medications for a consumer 1702. This could be the first time filling a prescription for a medication consumer, or it might be a 'forever' type of medications or set of medications to be filled. In this embodiment the health care practitioner knows that a special packaging method can be used and would work best given the one or more medications needed. The health care practitioner could be a pharmacist, doctor, dentist, long-term care home worker, a nurse practitioner, a loved one like a child looking after a parent or many other type persons.

They proceed to look for a bottom element to hold the medications. In those embodiments where a reusable top and bottom element are used, the health care practitioner first determines if a bottom element has been returned by, or on behalf of, the consumer for reuse 1704. In some embodiments such as a long-term care home, it could be common practice to collect all used blister packaging mechanisms when they are completed to be returned to the health care practitioner for reuse. Since each packaging mechanism is labeled with the consumer's name (or otherwise linked to the consumer), it allows for the careful reuse of the packaging mechanism for that same consumer.

It is possible that a consumer and a health care practitioner have arranged for two or more bottom elements to be in circulation between them and to be returned when completed. For example, while one is being prepared for the next week, a second one is being actively used in the current week.

If the health care practitioner does find a previous used bottom element, they perform an integrity check, clean the bottom element with a sterile wipe or following some other cleaning protocols and prepare to use it 1706. If they cannot find a previously used bottom element, they acquire a new bottom storage element to match the consumer's particular needs 1708. In some embodiments this decision is around how many daily doses the consumer's prescription requires as determined by a doctor. In other embodiments this could be related to a personal choice for supplements and vitamins that will be used within the packaging mechanism.

The health care practitioner then performs their normal loading process placing one or more medications into the one or more storage areas or containers, using the storage areas to distinguish different dosing periods 1710. In some cases this process can be performed by a machine that is built to pick and place medications into multiple storage bottom elements.

In those embodiments where a reusable top and bottom element are used, the health care practitioner then looks for a top element that might have been provided for reuse 1712. Like the bottom element, the health care practitioner and consumer might have agreed to have two or more top elements in circulation to allow for reuse. This allows one to be in active use, while a second one is being prepared for the following week.

If a top element has been found for reuse, the health care practitioner performs any integrity checks, cleans as necessary following their cleaning protocols and uses this top element 1714. If they are unable to find a top element for reuse, they acquire a new top element with one or more apertures that exactly match the storage areas and size of the bottom element 1716.

With the top element selected, the health care practitioner then couples the top and bottom elements and ensures the sliding middle section is in place and the one or more apertures cover the one or more storage areas holding the medications 1718. Finally, the security seal is added or checked depending on the embodiment and the type of security seal has been used 1720. The security seal might be added by the health care practitioner, or it could be already present on the top element depending on the type of top and bottom elements used. Finally, the data flow moves to FIG. 18 where the storage mechanism is delivered to a consumer.

Figure 18:
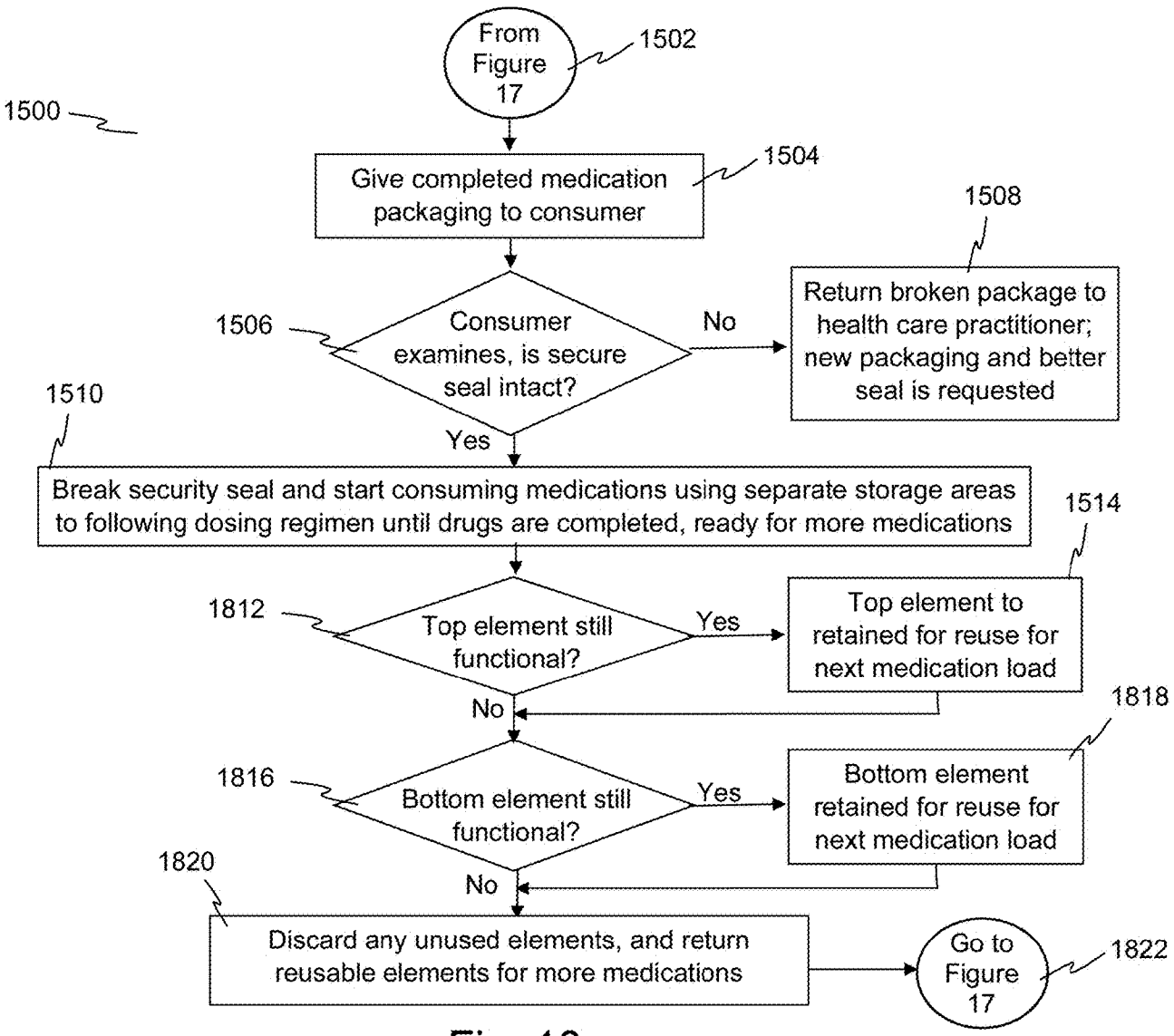
FIG. 18 is a data flow diagram illustrating the use of the packaging mechanism.

Moving to FIG. 18 there is a data flow diagram illustrating the use of the packaging mechanism. There are many embodiments and methods for using the packaging mechanism. It might be used directly by a person that has been called the medication consumer, it could be used within a piece of equipment that has been referred to as a drug dispenser or there could be many other embodiments.

In this embodiment the data flow comes in from FIG. 17, after a health care practitioner, like a Pharmacist has performed their initial step 1802. With the health care practitioner complete, the consumer now has a completed medication (or drugs) packaging mechanism in their possession 1804. The terms medication and drugs as used herein refer to items for the storage containers of the packaging. They can first examine the packaging mechanism to ensure that the security seal is intact and that no tampering has taken place 1806. If there has been tampering, perhaps during shipment to their house, or during the handling of the packaging mechanism in a long-term care home or in some other way, the broken package is returned to the health care practitioner that prepared the packaging mechanism for examination and a request is made for a new packaging mechanism with a better intact security seal 1808.

Otherwise, when the security seal is intact, the consumer can now break the security seal and start consuming medications 1810. They will follow their medication regimen and the health care practitioner's instructions as applicable to use the separate storage areas and the sliding middle section. In some embodiments, the consumer might move part or all of the medications to specialized carrying containers or dispensers for travel or safety. In other embodiments, the top element can couple temporarily with a specialized container that can fold into a small travel-size unit for going away on holiday and other options.

Once the contents of the packaging mechanism are exhausted, the consumer can examine the top element to see if it is still in good working order 1812. If it is the consumer can retain the top element for reuse for the next drug load in subsequent days or weeks 1814. If not, it will be discarded so that it does not stay in circulation.

Next the bottom element is checked to see it is in good working order 1816. If it is in good working order it is retained for reuse for the next drug load in subsequent days or weeks 1818.

When preparing the package to return to the original health care practitioner, like a pharmacy or such other location where the medication is loaded, the consumer now collects those elements that can still be reused and discards those elements that appear to be damaged or worn out 1820. In some embodiments, the consumer will have special arrangements with the health care practitioner to mail, deliver, exchange or physically drop off the usable elements back to them. In other embodiments, the health care practitioner, often a pharmacy, has arranged a weekly Pharmacy courier or some other arrangement to circulate reusable elements of the packaging mechanism. The data flow returns back to FIG. 17 (1822) where the health care practitioner receives any usable elements and proceeds to prepare the next packaging mechanism for the consumer.

Figure 19A:
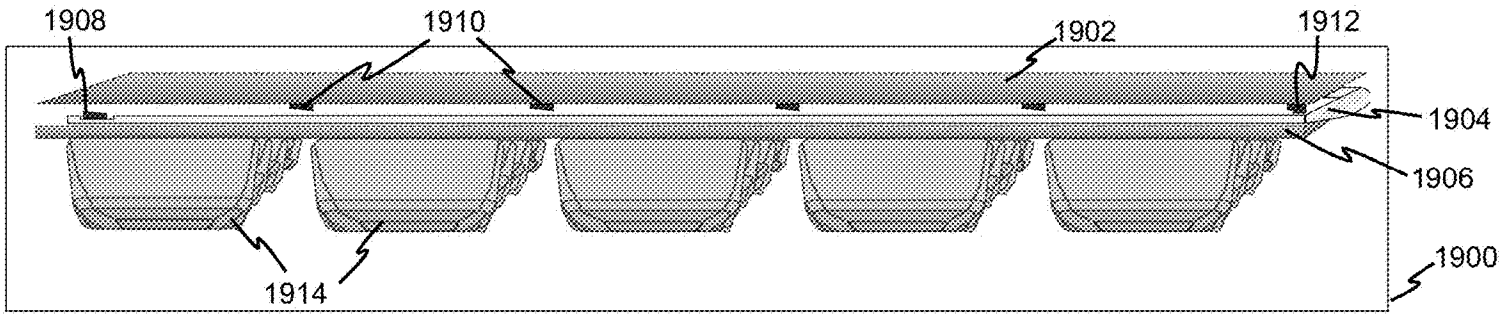
FIG. 19A is an overview illustrating of one embodiment of the inside of the sliding middle section used within the packaging mechanism.

Moving now to FIG. 19A there is an overview 1900 illustrating of one embodiment of the inside of the sliding middle section used within the packaging mechanism. The illustration is a cut-away of the side of the storage mechanism that highlights the top element 1902 and the sliding middle section 1904 that is associated with the top element 1902. Also shown is the bottom element 1906 with it associated storage areas 1914.

At the front of the sliding middle section 1904 is the presence of an element 1908 that provides a resistance mechanism. In some embodiments the resistance mechanism is by an element or added attachment identified by an additional piece of material added 1908, 1910 (which may be referred to as elements that provide resistance) to either the top element 1902 or the sliding middle section 1904 that can be used to resist the act of pulling the middle section 1904 at some point when moving from a closed position to a fully open position. In this embodiment to delineate where the location for resistance, there are elements or stationary points 1910 that when they come into contact with the sliding middle section 1904 and the additional piece of material 1908 will case additional drag on the pulling action. That is, elements 1908, 1910 work together to provide resistance for the sliding middle section 1904. The elements 1908, 1910 are at designated locations and increase friction of the sliding middle section 1904 when moving relative to the bottom element 1906 and the top element 1902 between the closed position and the open position. In some embodiments, the elements 1908, 1910 at the designated locations are for the exposing of the one or more storage areas through the one or more apertures of the middle section 1904 so that the storage areas are successively exposed in series or succession.

In other embodiments the element or resistance mechanism is a protrusion and grove as highlighted in FIG. 19A. There could be many different types of designs and mechanisms with different elements, tabs, protrusions, recess, notches, and indents to create additional resistance, friction, and drag on the pulling action of the middle section 1904.

In some embodiments the additional material 1908, 1910 used to create the resistance could be made of the same material used in the top element, for example cardboard or boxboard. In other embodiments the additional material 1908, 1910 could be a sticky adhesive, like a two-sided tape product. In yet other embodiments the additional material 1908, 1910 could be a sandpaper like stripe of tape used on both the stationary and moving components. In another embodiment the additional material 1908, 1910 could be a Velcro™ type strip to provide the resistance.

In one embodiment the goal of the resistance provided by the material or elements 1908, 1910 is to identify to the user when they have pulled the sliding middle 1906 to a certain point. This will be highlighted in FIG. 19B and FIG. 19C. In other embodiments there might be a reason to limit the speed of the pulling action or to ensure a child would be unable to pull it as it requires additional strength.

There are also different types of resistance that can be provided with the elements or resistance mechanisms 1908, 1910. In one example the resistance mechanism 1910 is used to slow down the sliding action using additional friction. The additional friction in turn then leading to additional strength required to move the sliding middle section 1904. In another embodiment the resistance mechanism 1912 is an end-stop mechanism that causes the sliding middle section 1904 to come to a full stop. The full stop would then require a great deal of strength to overcome and remove the sliding middle section 1904 completely.

Figure 19B:
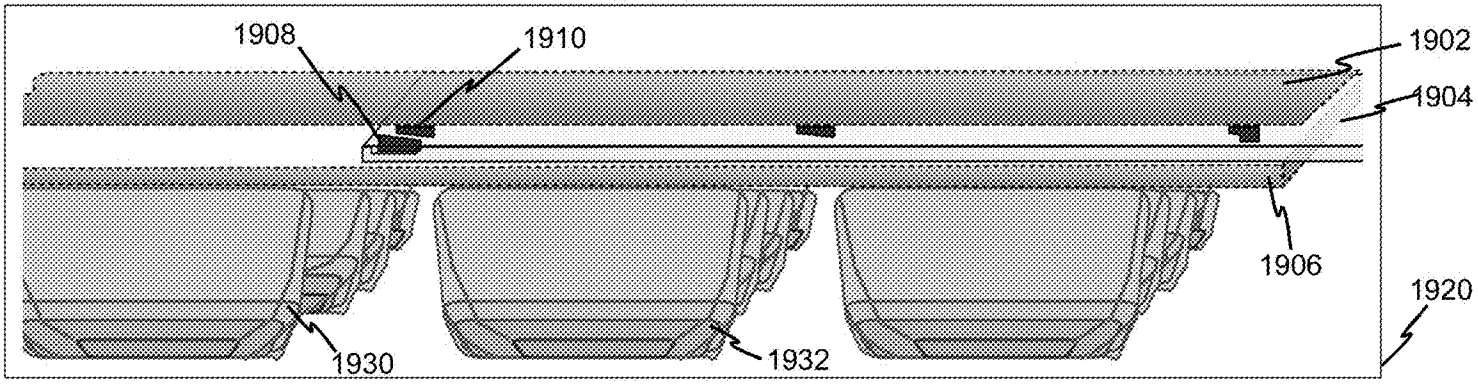
FIG. 19B is a closeup illustration of one embodiment of elements that provides a resistance mechanism used to create resistance for the sliding middle section within the packaging mechanism.

Moving now to FIG. 19B there is a closeup illustration 1920 of one embodiment of resistance mechanism elements 1908 (which can be referred to herein as an element), 1910 used to create resistance for the sliding middle section 1904 within the packaging mechanism. This illustration 1920 focuses on the coupling of the sliding middle section's 1904 resistance mechanism 1908 as it approaches the stationary top element's 1902 resistance mechanism 1910. The design of the two resistance mechanisms 1908, 1910 is such that a strong or a gentle resistance can be created based on the material and design of the two components 1908, 1010.

In this embodiment to angled pieces of material 1908, 1910 are used to meet and create resistance or friction to increase the drag thus increasing the strength needed to pull the sliding middle section 1904. This increased resistance can be customized for the application and requirement of the packaging mechanism. The material used could vary and many materials could be used. In one embodiment a foam-like material is used that compresses as the two resistance mechanisms 1908, 1910 come into contact. In another embodiment these two resistance mechanisms 1908, 1910 could be made of cardboard or boxboard material.

In this embodiment, the location of the stationary resistance mechanism 1910 is strategically placed between one set of storage areas 1930 and a next set of storage areas 1932. The set storage areas 1930, 1932 could be designated as horizontal set, a vertical set, different rows or even different columns depending on the construction of the overall packaging mechanism.

Figure 19C:
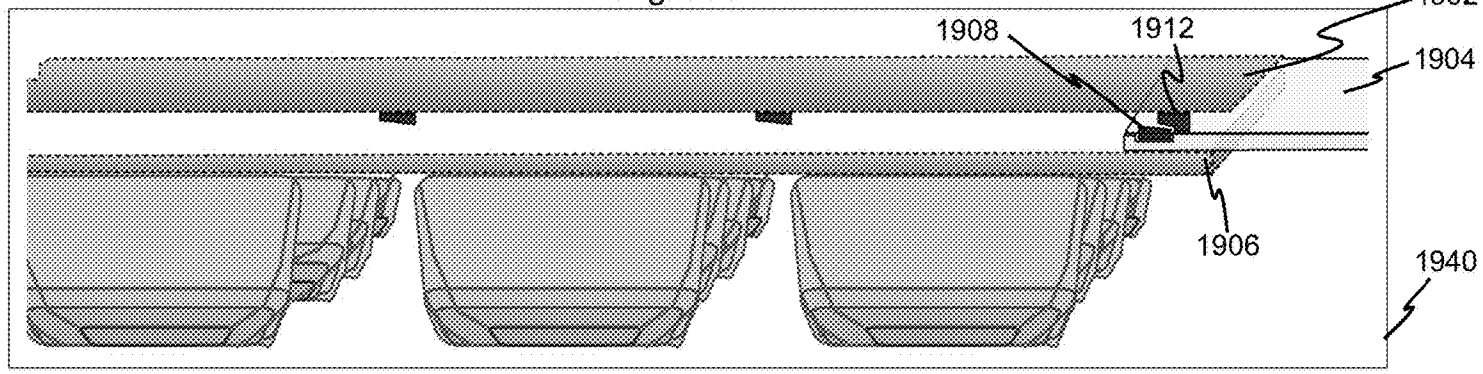
FIG. 19C is a closeup illustration of one embodiment of an end-stop mechanism used to stop sliding middle section within the packaging mechanism.

Moving now to FIG. 19C there is another illustration 1940 of one embodiment of an end-stop mechanism or element 1912 used to stop sliding middle section 1904 within the packaging mechanism. In this illustration the resistance mechanism on the sliding middle section 1904 is the same but the design of the end-stop mechanism 1912 is specially designed for catch, couple and stop the sliding middle section 1904 from continuing.

There are many possible designs for this end-stop mechanism and the one shown is not meant to limit other designs. In this illustrated design the end-stop mechanism or element 1912 is angled with a strong right angled protruding end that almost touches the sliding middle section 1904. Due to its lower profile the resistance mechanism on the sliding middle section 1904 is unable to easily pass by, even with stronger force.

Depending on the material this end-stop mechanism 1912 could create a deterrent from removing the sliding middle section 1904 or just a medium strength deterrent. In those embodiments where the material used is foam, the amount of strength required to full pry away the sliding middle section 1904 would be modest. In those embodiments where the end-stop mechanism 1912 and the resistance mechanism 1908 where cardboard or boxboard it would be much harder to break the sliding middle section 1904 completely free.

Figure 20A:
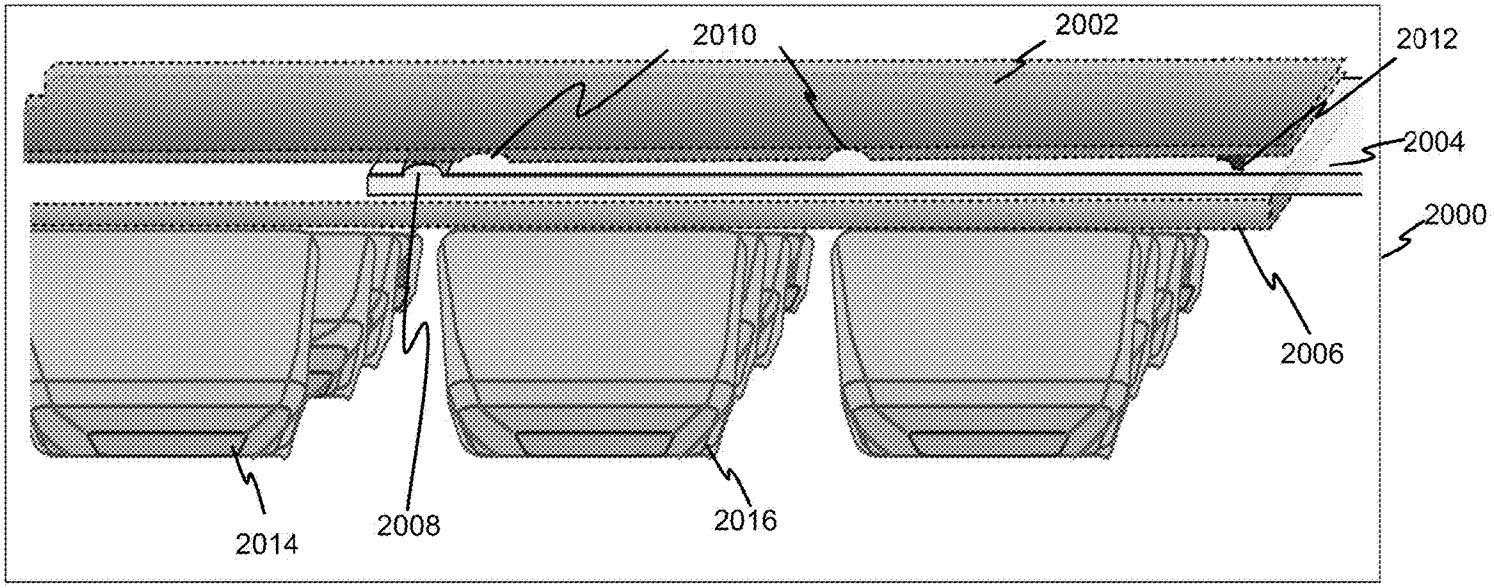
FIG. 20A is a closeup illustration of another embodiment of elements that provide a resistance mechanism used to create resistance for the sliding middle section within the packaging mechanism.

Moving to FIG. 20A there is a closeup illustration 2000 of another embodiment of a resistance mechanism used to create resistance for the sliding middle section 2004 within the packaging mechanism. In this illustration 2000 the top element 2002 has indentations or groves 2010 set into the construction at different intervals. As already discussed, these intervals could be related to groups of storage areas 2014, 2016 or they could be designed to slow down the pulling action for other reasons.

The groves 2010 of the top element 2002 are complemented by a protrusion 2008 on the sliding middle section 2004 that creates resistance when they come into contact. A series of groves 2010 can appear on the top element 2002 based on the specific needs of the packaging mechanism.

In this embodiment, the last location 2012 shows an extended protrusion 2012 from the top element 2002. This design will result in an end-stop behaviour of the sliding middle section 2006 when it comes into contact with the protrusion 2012 on the top element 2002. In another embodiment the protrusion 2012 might be a much deeper grove that creates a stronger sense of when to stop the pulling action.

Figure 20B:
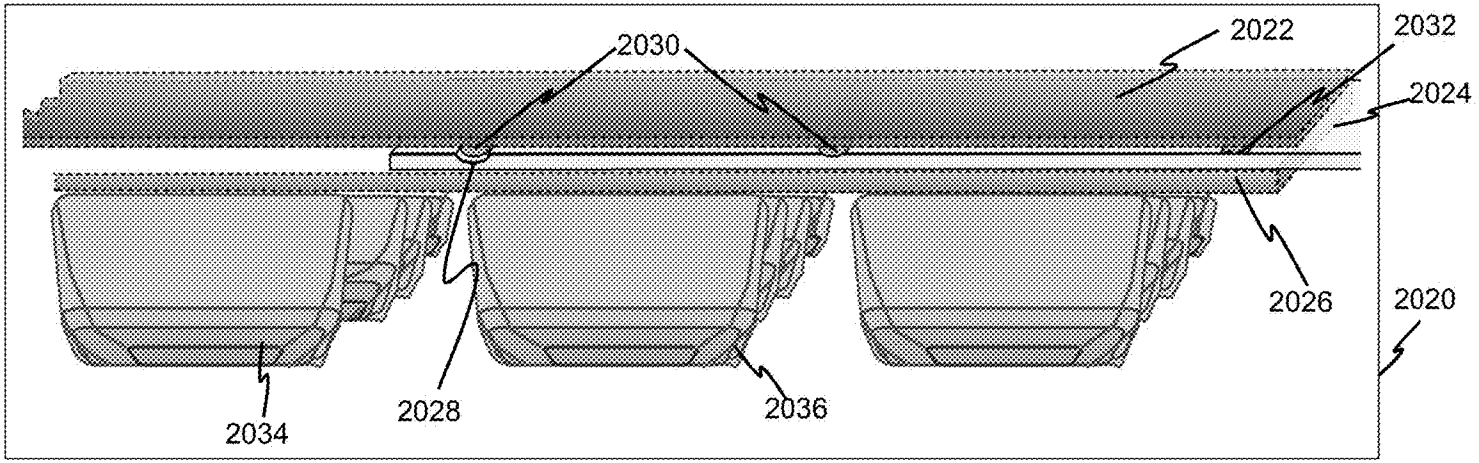
FIG. 20B is a closeup illustration of another embodiment of elements that provide a resistance mechanism used to create resistance for the sliding middle section within the packaging mechanism.

Moving to FIG. 20B there is a closeup illustration 2020 of another embodiment of a resistance mechanism 2028, 2030 used to create resistance for the sliding middle section 2004 within the packaging mechanism. In this embodiment the grove is located on the sliding middle section 2024 instead of the top element 2002. Instead, the top element 2022 has a series of protrusions 2030 to delineate location where additional resistance is created on the pulling action of the sliding middle section 2024.

At the end of the top element 2022 an end-stop protrusion is present with a different structure that will catch the grove 2028 in the sliding middle section 2024 to create a much harder resistance signaling the end of the middle section's 2024 movement. In this embodiment the end-stop protrusion 2032 is shown with an angular structure to get lodged within the grove 2028 of the sliding middle section 2024. In other embodiments this could be a similar design as the earlier resistance protrusions but made much larger, thus allowing it to enter into the grove 2028 more deeply.

These embodiments many other designs are possible to create a resistance to the pulling action of the sliding middle section 2024.

Figure 21:
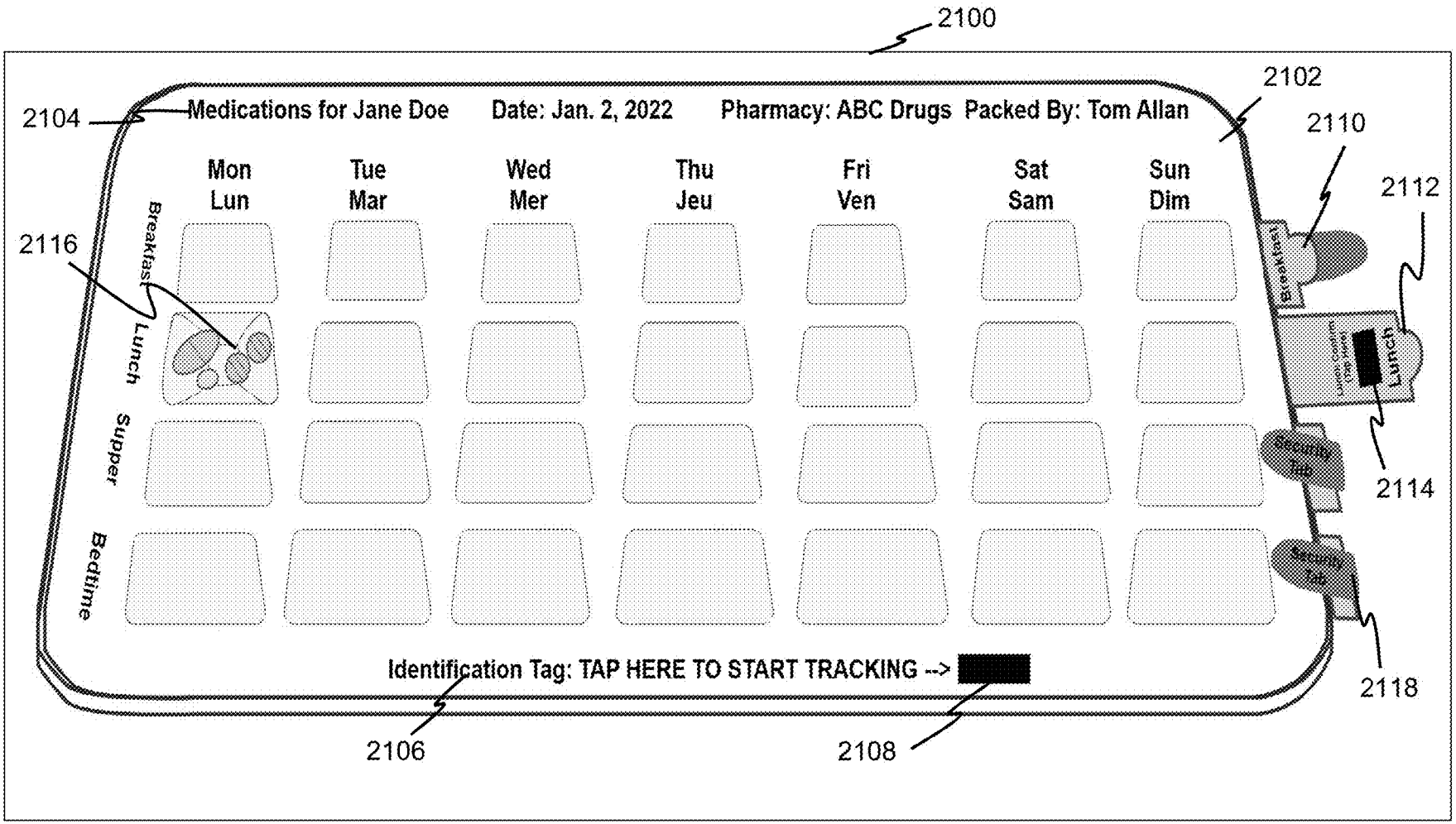
FIG. 21 is a top view illustration of an embodiment where identification tags are used in conjunction with the packaging mechanism.

Moving to FIG. 21 there is a top view illustration 2100 of an embodiment where identification tags 2108, 2114 are used in conjunction with the packaging mechanism. To address issues of tracking medication consumption the packaging mechanism is capable of being constructed with embedded identification tags 2108, 2114. There are many embodiments for identification tags 2108, 2114 include near field communication (NFC) tags, passive RFID tags and others. Passive RFID tags 2108, 2114 can also vary in strength and low-frequency (LF) RFID tags and high-frequency (HF) RFID tags.

NFC tags are an implementation of HF RFID tags that use short-read ranges and must be in close proximity. Various types of devices can be used to read such RFID and NFC tags include RFID tag readers, mobile phones, NFC readers and others. When using these embedded identification tags additional supports and controls can be added to the packaging mechanism to help solve problems of medication adherence, reminder systems and better drug outcomes especially for vulnerable populations like seniors and the infirmed.

In one embodiment a health care practitioner is preparing a packaging mechanism for a medication consumer. They go through their normal process and select a specialized top element 2102 to support this medication consumer. The printed label 2104 indicating who the medication is for by name, the date it was prepared, the date the medication should start on and who packed the medication 2104.

In some embodiments the health care practitioner also connects to a specialized service and provides the name of the medication consumer and the identification tag 2108 for the entire packaging mechanism. By using a mobile phone, an RFID reader, an NFC reader or some device they tap or come into close proximity to the tag identifier 2108. Once collected, the mobile phone, RFID read, NFC reader or specialized device then forwards the tag identifier 2108 to the specialized service with the name of the medication consumer. By using this process the health care practitioner can provision this packaging mechanism to this medication consumer to help ensure it is received by the right person when it is suppose to be.

In another embodiment the health care practitioner does not bother to scan the identification tag 2108 for the entire packaging mechanism. This might be left up to the destination location where the packaging mechanism has been prepared for and delivered to. For example, it might be the packaging mechanism is for a resident in a congregate living situation within a senior's home, long-term care home or adult-only residence. Once received the management or staff members log the arrival of the packaging mechanism by scanning the identification tag 2108 before delivering it to the residence room in the larger facility.

In yet another embodiment the identification tag 2108 is only scanned by the medication consumer themselves. In some embodiments a medication consumer might only be using an 'mobile app' on their phone or an application on their laptop to help them remember to take their medication and to remind them when they forget to take their medications. This may be useful if they have multiple packaging mechanisms, or if they are living with someone with their own packaging mechanism it would be a very fast method to ensure you are taking medications from the correct packaging mechanism.

In other embodiments the identification tag for the entire packaging mechanism is never scanned as the provisioning step is not important to the medication consumer. They might not need assurances that they are using the correct packaging mechanism so do they not bother with the identification tag 2108 for the entire packaging mechanism.

In some embodiments, after the scan of the identification tag 2108 for the packaging mechanism is complete, the medication consumer can then proceed to take regular doses of their medication. Using the previous described security tab 2118 protection mechanism the medication consumer proceeds to open the security tab 2110 and access medications as normal. Each time their access a given storage area 2116 the security tab 2110 shows that they have performed that action the very first time. After the first time the security tab 2110 remains open and the medication consumer is not able to tell as much information from the position of the security tab 2110.

As the medication consumer actively accesses a given sliding middle 2112, a different identification tag is exposed 2114 with a different identification number from the identification number used for the entire packaging mechanism. In some embodiments these are related. For example, the RFID value is sequentially assigned based on the entire packaging mechanism's identification number. For example, if the general number 2108 for the packaging mechanism is 12345000, then the corresponding identification tags 2114 for this illustration might be 12345001, 12345002, 12345003 and 12345004. In this illustration these additional 4 numbers would correspond to the 4 doses per day allowed by this packaging mechanism configuration.

Although this example shows 4 doses per day for a period of 7 days there are no limits to the combination of potential doses per day and the number of days that could be supported with the system and identification tags 2108, 2112. There could be 8 doses a day over 14 days and many other combinations.

By having the medication consumer, who might in some cases be a nurse, a personal support worker (PSW) a loved one, a child, a doctor, a parent tap on the specific dosing identification tag 2114 they enable the notification options that are possible with the packaging mechanism. For example, a mobile phone app might provide reminders when drugs are due, but it then needs the additional dosing identification tag 2114 information to provide follow-on reminders that medication have been not taken or even missed.

In those embodiments where a specialized server is utilized, the arrival or the absence of the correct identification numbers can signal different events and situations. These triggers can then send alarm and alerts to loved ones and caregivers of the medication consumer. For example, if a breakfast dose identification number does not arrive in within one hour of lunch an email, social media message, SMS text message or some other kinds of alert can be sent to configured individuals helping to care for and track a given medication consumer. When a medication consumer if mentally compromised, elderly, frail and still living in their home or living alone these types of alarms and alerts can help to save lives.

In some embodiments these reminders are received by a device like a mobile phone, a specialized RFID reader equipment with cellular capabilities like an Internet of Things (IoT) chipset to communication identification tag 2108, 2114 information back to a specialized service to indicate when medications have been consumed or not. The specialized RFID reader equipment might have an RFID or NFC type reader and Wi-Fi capabilities only to reach the specialized service. In other embodiments a tag reader could be combined with a Bluetooth chipset within a wearable lanyard type device to communication with a mobile device that is not capable of reading the tag identification but can communicate via Bluetooth protocols. This might be valuable in cases where a specialized RFID is used that is not compatible with all mobile phone technologies.

In other embodiments the identification tag 2108, 2114 information is delivered only to a mobile device, a lanyard, a wearable watch, or some other device to act as a confirmation and reminding mechanism for a medication consumer. This might happen directly by an NFC tap; it could even happen over Bluetooth as just described.

In these embodiments where a standalone application is used on the mobile device, a laptop, a tablet or used on some other computer system, it allows for advanced methods of supporting medication consumption. These types of solutions are needed to help ensure medication compliance, safer medication consumption and better medication outcomes for everyone who finds it necessary to consumer medications.

In other embodiments there could be multiple identification tags (not shown) to indicate how far a given sliding middle 2110 is being pulled. For example, in this illustration it appears the medication consumer has already had their Monday morning dose 2110 as the security tab has been released and lies open 2110. This medication consumer is now on their Monday lunch medication dose 2112 and are about to take out their medications 2116. When it comes time for the medication consumer to take their Tuesday breakfast dose a second identification tag would be present on the breakfast sliding middle section 2110. By reading this second identification tag the information can be forward to a mobile device or to a specialized server to record that a second day of breakfast medications have been consumed.

In this embodiment the identification numbers used on the sliding middle identification tags 2114 could be related to make it easy to understand the exact dose location of the identification tag 2114. For example, if the general identification tag had a number of 9876-00-00 the various breakfast identification tags could be 9876-01-01, 9876-01-02, 9876-01-03 and 9876-01-04 up to 9876-01-07 for the seventh and last day. Continuing with this example, the lunch identification number would be 9876-02-01, 9876-02-02, 9876-02-03 up to 9876-02-07. Following these patterns allows the mobile device, specialized device and specialized server can use these related identification number to distinguish exactly what has happened and when— so long as the medication consumer or their support person performs the tag reading operation.

Although in this embodiment the sliding middle sections 2112 are shows coming from left to right moving from Monday (fully closed) through to Sunday (fully open) other embodiments are possible as shown earlier. In other embodiments the sliding middle section 2112 might be pulled from the bottom portion, moving from top (fully closed) to bottom (fully open). In yet other embodiment as discussed early, there might be only a single sliding middle section 2112 that exposes a full row or a full column of drugs. In this case a single identification tag 2114 or multiple identification tags 2114 might be used to indicate a full row or a full column had been accessed by the medication consumer.

The invention claimed is:

1. A system of resealable packaging for holding medications, the system comprising:

a bottom element with one or more storage areas sized to contain one or more medication for consumption;

a top element of a corresponding size to the bottom element, wherein the top element couples to the bottom element, the top element having one or more apertures to expose the one or more storage areas of the bottom element;

the top element having a sliding middle section movable relative to the bottom element and the top element between a sealed closed position to cover the one or more apertures to seal the one or more storage areas of the bottom element and an open position to uncover at least one of the one or more apertures to expose the one or more storage areas and provide access to any medications contained therein, wherein the sliding middle section is movable between the open position and the sealed closed position to cover the exposed one or more storage areas;

a security seal that couples to at least one of the top element and the bottom element to limit the movement of the sliding middle component.

2. The system of claim 1 wherein the security seal is breakable to allow movement of the sliding middle section, wherein breakage of the security seal indicates access to at least one of the one or more storage areas.

3. The system of claim 1 wherein the top element is coupled to the bottom element by an adhesive material.

4. The system of claim 1 wherein the top element has a receiving rail, wherein the top element is coupled to the bottom element by aligning the bottom element with the receiving rail on the top element and sliding the bottom element along the receiving rail.

5. The system of claim 4 wherein the bottom element slides along the receiving rail to uncouple from the top element for the reuse of the top element and the bottom element.

6. The system of claim 1 wherein the security seal covers a pull tab for the sliding middle section.

7. The system of claim 1 wherein the security seal connects to the top element and the bottom element.

8. The system of claim 1 wherein the security seal is a tear tab that physically connects the sliding middle to one of the top element and the bottom element.

9. The system of claim 1 wherein the security seal is an adhesive material that connects the sliding middle with the stationary top element or bottom element.

10. The system of claim 5 further comprising a second security seal between the top element and the bottom element to restrict the sliding movement of the top element and the bottom element and wherein the second security seal is breakable to permit movement and indicate tampering.

11. The system of claim 1 wherein the sliding middle section is a single piece of movable material.

12. The system of claim 1 wherein the one or more storage areas are arranged in one or more rows of storage areas, wherein the sliding middle section comprises a plurality of subsections corresponding to the one or more rows of storage areas located in the bottom element.

13. The system of claim 1 wherein the one or more storage areas are arranged in one or more columns of storage areas, wherein the sliding middle section comprises a plurality of subsections corresponding to one or more columns of storage areas located in the bottom element.

14. The system of claim 1 wherein the top element and the sliding middle section comprise one or more elements at designated locations that increase friction of the sliding middle section when moving relative to the bottom element and the top element between the closed position and the open position.

15. The system of claim 14 wherein the elements at the designated locations are for the exposing of the one or more storage areas through the one or more apertures of the middle section.

16. The system of claim 1 wherein the top element and the sliding middle section include an end-stop element that stops the sliding middle section from being fully removed from the top element.

17. A system of claim 1 wherein the top element has an identification tag indicating the provisioning of the packaging and one or more dose specific identification tags related to medication consumption.

18. A system of claim 1 further comprising an identification tag to indicate the reception of medications and one or more identification tags to indicate that the sliding middle section has moved to expose the one or more storage areas.

19. A system of resealable packaging comprising:

a bottom element with one or more storage areas;

a top element of a corresponding size to the bottom element, wherein the top element couples to the bottom element, the top element having one or more apertures to expose the one or more storage areas of the bottom element;

the top element having a sliding middle section movable relative to the bottom element and the top element between a sealed closed position to cover the one or more apertures to seal the one or more storage areas of the bottom element and an open position to uncover at least one of the one or more apertures to expose the one or more storage areas; and a security seal that couples to at least one of the top element and the bottom element to limit the movement of the sliding middle component;

wherein the sliding middle section is movable between the open position and the sealed closed position to cover the exposed one or more storage areas;

wherein the top element and the sliding middle section comprise one or more elements that increase friction of the sliding middle section when moving relative to the bottom element and the top element between the closed position and the open position;

wherein the top element has a receiving rail, wherein the top element couples to the bottom element by aligning the bottom element with the receiving rail on the top element and sliding the bottom element along the receiving rail.

20. A method of using resealable packaging having a bottom element with one or more storage areas and an access top element, the method comprising:

filling the bottom element with one or more distinct and separate storage areas with one or more drugs such that the filled one or more distinct and separate storage areas correspond to dosing periods for the one or more drugs;

coupling the access top element to the bottom element, the access top element having a middle section covering the one or more storage areas of the bottom element so that the one or more drugs in the one or more storage areas are covered, the middle section moveable to expose or uncover at least one of the one or more storage areas;

attaching a security seal, wherein the security seal is breakable to indicate that the access top has been used to access one or more of the drugs held within the one or more storage areas.

* * * * *